US006101721A

United States Patent [19]

Medhurst

[11] Patent Number: 6,101,721

[45] Date of Patent: Aug. 15, 2000

[54] CUTTING/SCRAPING TOOL

[75] Inventor: Simon M. Medhurst, Burlington, Canada

[73] Assignee: 1360314 Ontario Limited, Burlington, Canada

[21] Appl. No.: 09/315,043

[22] Filed: May 20, 1999

[51] Int. Cl.[7] ..... B26B 1/08

[52] U.S. Cl. ..... 30/125; 30/162; 30/169; 30/335

[58] Field of Search ..... 30/125, 151, 162, 30/169, 335, 337; 15/236.01, 236.02, 236.05

[56] References Cited

U.S. PATENT DOCUMENTS

| | | | |
|---|---|---|---|
| 2,291,514 | 7/1942 | Warner et al. | 30/162 |
| 2,601,723 | 7/1952 | Keller | 30/162 |
| 3,964,162 | 6/1976 | Gerson et al. | 30/125 |
| 4,005,525 | 2/1977 | Gringer | 30/125 |
| 4,277,888 | 7/1981 | Szabo | 30/162 |
| 4,558,517 | 12/1985 | Gringer | 30/169 |
| 4,615,118 | 10/1986 | Ihata | 30/151 |
| 4,761,882 | 8/1988 | Silverstein | 30/162 |
| 5,042,154 | 8/1991 | Gilbert | 30/162 |
| 5,319,853 | 6/1994 | Schmidt | 30/169 |
| 5,604,984 | 2/1997 | Shepherd et al. | 30/125 |
| 5,727,320 | 3/1998 | Shepherd et al. | 30/125 |

*Primary Examiner*—Hwei-Siu Payer

*Attorney, Agent, or Firm*—Patrick J. Hofbauer

[57] ABSTRACT

A cutting/scraping tool is disclosed, comprising a housing defining a longitudinal axis, a transverse chamber, and a blade chase adjacent a forward end of the housing. A cartridge is releasably retained within the chamber by detent lugs extending laterally from an outer surface of the cartridge in frictional engagement with a plurality of complementary detent recesses positioned on the housing. A blade within the cartridge is in aligned registry with the blade chase. A deflector is positioned beneath the blade. A transport mechanism is slidably mounted on the housing for substantially longitudinal movement between forward, intermediate and rearmost positions. An actuator projects from this housing to effect the sliding movement of the transport mechanism. The transport mechanism has a flexible, resilient tongue portion. A tab is formed on the tongue portion within the housing adjacent a forward end of the transport mechanism. The transport mechanism is rearwardly removed from the cartridge at the rearmost position. Sliding movement of the transport mechanism from the rearmost position to the intermediate position causes the tab to enter the cartridge beneath the blade, and be deflected upwardly by the deflector, to carryingly engage a socket positioned on an underside of the blade. Sliding movement of the transport mechanism from the intermediate position to the forward position causes the tab to carry the blade from the cartridge to project in an operative position from the blade chase, so as to present a sharpened edge of the blade for use.

18 Claims, 20 Drawing Sheets

CUTTING/SCRAPING TOOL

FIELD OF THE INVENTION

The present invention relates to the field of hand-held blade tools, and more particularly, to a hand-held blade tool intended for use in scraping or cutting operations.

BACKGROUND OF THE INVENTION

Hand-held blade tools are used in a wide variety of cutting and scraping activities in daily use.

For efficient operation, it is desirable that such tools be maintained with a sharp edge. For this purpose, it is known in the prior art for blade tools to utilize inexpensive disposable blades. For reasons of safety in storage, it is desirable that the blades of such tools may be shielded when not in use; for this purpose, it is known in the prior art for tools to employ a blade carrying member that is retractable within a housing and upon which a single disposal blade may be removably mounted. Examples of such prior art blade tools, for use in cutting and scraping operations, respectively, are shown in U.S. Pat. No. 4,761,882 (Silverstein), issued Aug. 9, 1988, and U.S. Pat. No. 2,601,723 (Keller), issued Jul. 1, 1952.

These types of single blade tools are known to be relatively economical to purchase and use, and to be relatively reliable in operation. However, in relation to both such tools, when the blade becomes worn, the operator is exposed to danger of injury from the sharpened edges of the blades during their replacement. As well, the blade replacement operation is relatively cumbersome and time-consuming, and typically requires the operator to cease whatever activity he or she is engaged in to effect the replacement of the blade.

Accordingly, a number of blade tools are known in the prior art which attempt to provide, in a safer, quicker and more convenient manner, for a replacement supply of new blades to be interchanged as required.

One example of such a prior art blade tool is that shown in U.S. Pat. No. 4,277,888 (Szabo), issued Jul. 14, 1981, which discloses a utility knife having a magazine in which a plurality of blades are stacked, a blade changing device which pushes a blade from the top of the stack into an operating position, and pulls said blade underneath the stack when it has become worn. Such an arrangement resolves the aforementioned safety concern to a large extent, and provides for relatively quick blade exchange, albeit, requiring two hands to effect such exchange. However, this design suffers from undue complexity of assembly, and unduly high production costs. As well, this design suffers in that utility knives are often used for tasks wherein the blades become soiled or coated with foreign material, which soiling and coating tends to impair the reliability of the blade exchange operation. Finally, the utility knife disclosed in this patent provides only for sequential access to the replacement blades, which can result in a blade which is slightly worn, but still acceptable for normal use, being prematurely exchanged in circumstances where a very sharp edge is required for a particular and infrequent use.

U.S. Pat. No. 4,615,118 (Ihata), issued Oct. 7, 1986, discloses another common type of utility knife. The knife described in the Ihata patent comprises a magazine portion which can be fitted into a magazine storage cavity that extends within a rear portion of the knife. A plurality of strip-like blades having pre-stamped lines of breakage at uniform spacing are fitted within the magazine. A respective one of the blades may be selectively extended so as to present a front portion of the blade for use. When said front portion of the blade has become worn and unusable, the blade may be broken along the foremost line of breakage, and an unused portion of the blade may then be extended for use. This type of knife is economical to purchase and operate, and provides for convenient retraction of the blade for storage. However, the danger of injury in the prior art is continued in this design, as the spent strip blades must be fully extended to the front of the knife and manually removed, so that the next strip blade may be engaged. As well, the removal of the blade sections exposes the user to the additional risk of injury from metal fragments.

U.S. Pat. No. 5,604,984 (Shepherd et al.), issued Feb. 25, 1997, shows another prior art utility knife. The utility knife disclosed in the Shepherd patent comprises a cylindrical blade magazine removably mounted in a manually holdable housing and rotatable about an axis parallel to a longitudinal axis of the housing, the housing having a slidable transport mechanism which carries a blade from the magazine into an operative position, and returns same to the magazine for storage. Rotation of the blade magazine causes the retracted blade to be removed from the transport mechanism, and a new blade to be engaged by the transport mechanism, for subsequent movement of the new blade from the magazine into the operative position. The Shepherd knife resolves the aforementioned safety concern, and as well, allows for selective, non-sequential and relatively convenient access to the plurality of blades stored in the magazine. However, this knife maintains the problem of unduly high production costs, and also suffers from the requirement that the rear portion of the knife must be of a rather large bulbous shape to contain the cylindrical magazine, which is an impediment to the production of an ergonomically friendly and aesthetically pleasing knife. As well, the complexity of the blade magazine employed in this knife necessitates a high-replacement value, resulting in unduly high operating costs for this knife.

Moreover, none of the known prior art blade tools having a plurality of blade members which may be conveniently exchanged without risk of injury provide for scraper blades of the type shown in the Keller patent, wherein the sharpened edge of the blade in use is presented in an orientation normal to the handle. Rather, such prior art blade tools provide for the sharpened edge of the blade in use to be presented in an orientation substantially parallel to the handle, only, which does not particularly suit them for use in scraping operations.

SUMMARY OF THE INVENTION

It is an object of the present invention to overcome, inter alia, the shortcomings of the prior art described above by providing a blade tool that is economical to manufacture, purchase and use, that is reliable in operation, that provides for non-sequential access to a convenient supply of replacement blades, that does not expose the operator to risk of injury during the blade replacement process, and which is readily adaptable into both cutting and scraping embodiments.

It is a further object of the present invention to provide a blade tool which satisfies the aforementioned objects by the provision of an interchangeable disposable blade cartridge having a plurality of blades therein which may be non-sequentially accessed by the operator.

It is yet a further object of the present invention to provide a blade tool which satisfies all of the aforementioned objects and which allows blade exchange to be relatively quickly accomplished by the operator with the use of just one hand.

These and other objects are addressed by the present invention, a cutting/scraping device.

According to one aspect of the present invention, the cutting/scraping device comprises a manually grippable housing. The housing defines a longitudinal axis, and has a head portion adjacent a forward end of the housing, a handle portion adjacent a rearward end of the housing, an axially aligned blade chase formed in the head portion of the housing, and a cartridge receiving chamber passing substantially through the housing and defining a substantially transverse axis. A blade cartridge, having a blade and a slot, with the blade positioned in the slot, is also provided. Cartridge positioning means, comprised of at least two co-operating portions respectively mounted one portion each on an outer surface of the blade cartridge and on the housing adjacent a perimeter of the cartridge receiving chamber, engage one another to releasably retain the blade cartridge within the cartridge receiving chamber. The blade cartridge is releasably retained as aforesaid with the blade in aligned registry with the blade chase so as to define a loading position. A slidable transport mechanism is mounted on the housing for sliding movement along an axis substantially parallel to the longitudinal axis between forward and intermediate positions and has a manually engageable actuator projecting from the housing to effect said sliding movement of the transport mechanism. The transport mechanism has a blade engaging detent means positioned on the transport mechanism within the housing adjacent a forward end of said transport mechanism for carrying engagement with said blade. Positioning of the transport mechanism at the forward position causes the blade, carried from the slot by the detent means, to project in an operative position from the blade chase, so as to present a first sharpened edge of said blade for use. Sliding movement of the transport mechanism from the forward position to the intermediate position causes the blade to be retracted from said operative position to the loading position.

According to another aspect of the invention, the transport mechanism is preferably adapted for slidable longitudinal movement to a rearmost position rearwardly disposed from the intermediate position. Sliding movement of the transport mechanism from the intermediate position to the rearmost position causes the blade engaging detent means to disengage from the blade when the blade is at the loading position.

According to another aspect of the invention, the transport mechanism is preferably fully removed rearwardly from the blade cartridge when the transport mechanism is at the rearmost position, so as to permit selective transverse removal of the blade cartridge from the cartridge receiving chamber.

According to another aspect of the invention, the transport mechanism comprises a flexible, resilient forwardly-directed tongue portion. The blade engaging detent means is preferably formed adjacent a forward end of the tongue portion. The blade cartridge further comprises a deflector means fixedly positioned beneath the blade in the blade cartridge. The tongue portion and the deflector means are adapted such that, upon selective movement of the transport mechanism from the rearmost position to the intermediate position, the detent means enters into the blade cartridge beneath the blade, and is deflected upwardly by the deflector means to carryingly engage a first socket means positioned on an underside of the blade for subsequent carriage of the blade by the transport mechanism from the loading position to the operative position as aforesaid.

According to another aspect of the invention, the deflector means preferably comprises an inclined ramp portion. Upon selective movement of the transport mechanism from the rearmost position to the intermediate position, the detent means enters the cartridge beneath the blade in a direction substantially parallel to the longitudinal axis, and is thereafter deflected upwardly by the inclined ramp portion to carryingly engage the first socket means.

According to another aspect of the invention, the blade cartridge preferably further comprises a plurality of substantially planar blades positioned within the slot in the blade cartridge in vertically stacked, spaced, substantially parallel relation, with a plurality of deflector members interleaved one each therebetween. The cartridge positioning means is adapted for selective movement of the blade cartridge along the transverse axis to move a selected one of the plurality of blades into the loading position for subsequent selective movement by the transport mechanism to the operative position.

According to yet another aspect of the present invention, the first sharpened edge of the selected blade is oriented horizontally and substantially normal to the longitudinal axis of the housing when the selected blade is at the operative position, and wherein the handle is shaped and dimensioned for ergonomic comfort for substantially horizontal movement of the cutting/scraping tool.

According to one further aspect of an alternative embodiment of the present invention, the first sharpened edge of the selected blade is oriented horizontally and substantially parallel to the longitudinal axis of the housing when the selected blade is at the operative position, wherein the plane of the selected blade is oriented substantially vertically, and wherein the handle is shaped and dimensioned for ergonomic comfort for substantially vertical movement of the cutting/scraping tool.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

DETAILED DESCRIPTION OF A PREFERRED EMBODIMENT

Figure 1:
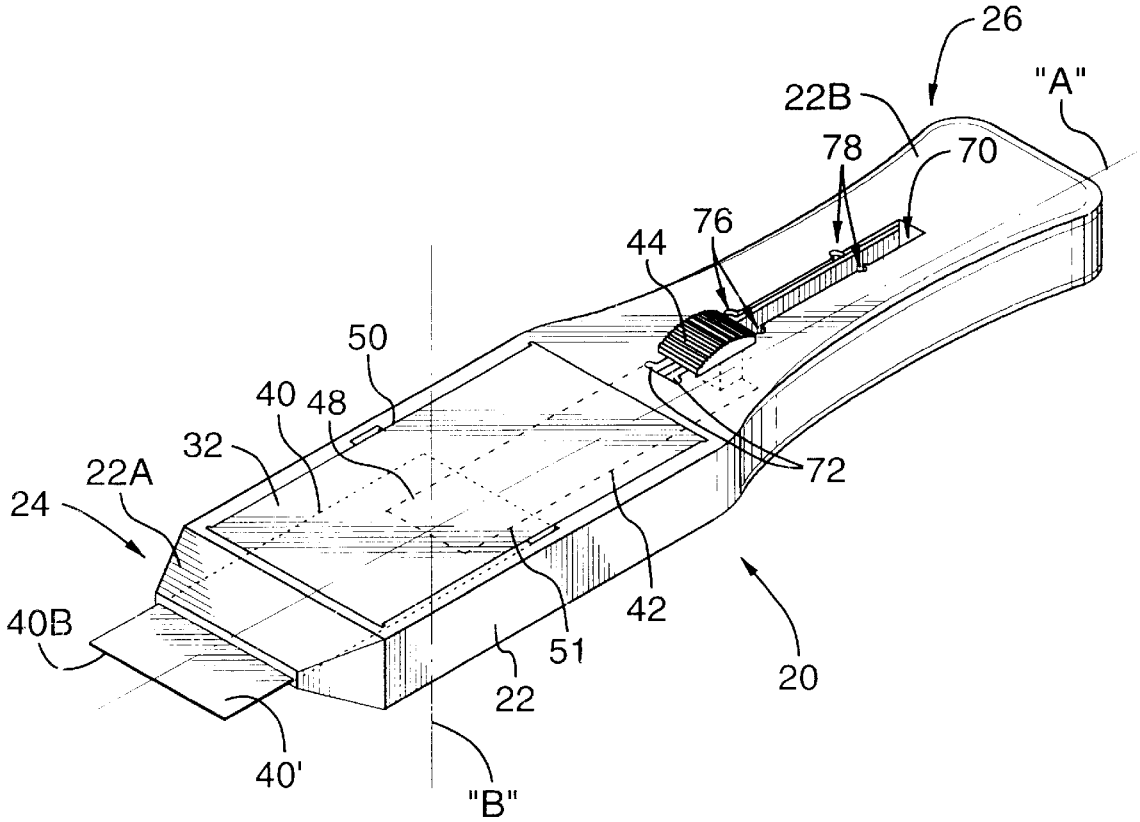
FIG. 1 is a perspective view of a cutting/scraping tool according to a preferred embodiment of the present invention, shown with the transport mechanism at a forward position and a selected blade at an operative position projecting from the blade chase, that portion of the selected blade within the housing and the tongue portion of the transport mechanism being shown in phantom outline.
Figure 2:
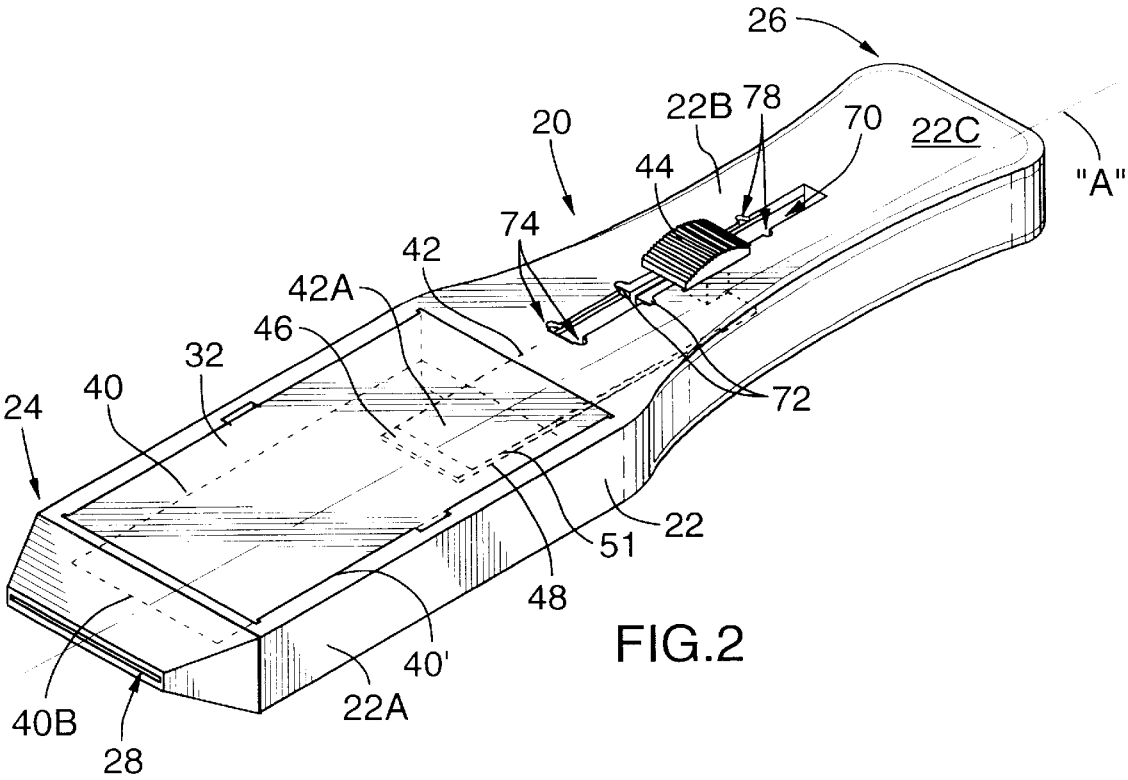
FIG. 2 is a view similar to FIG. 1, with the transport mechanism at an intermediate position, and the blade retracted within the blade cartridge to a loading position.
Figure 3:
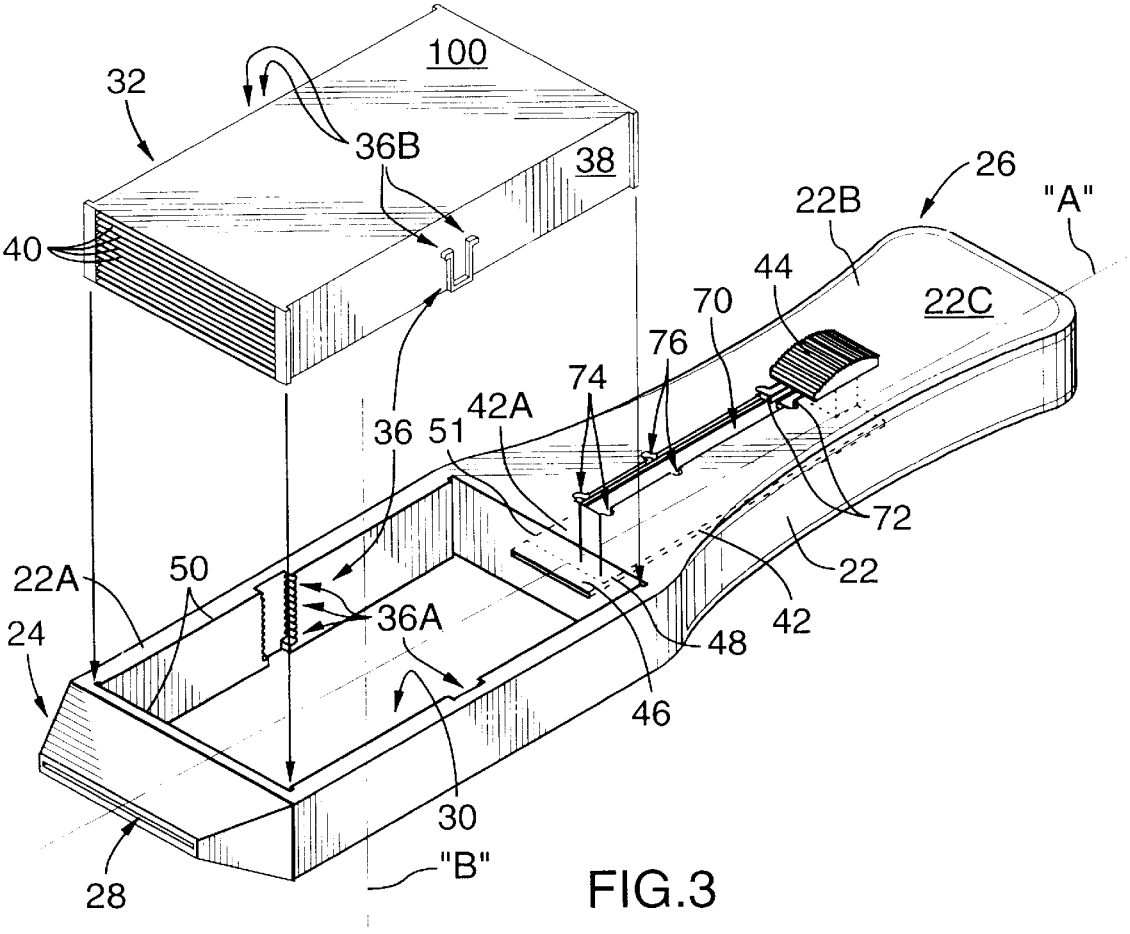
FIG. 3 is a view similar to FIG. 1, with the transport mechanism at the rearmost position and the blade cartridge upwardly transversely removed from the cartridge receiving chamber.

With general reference to FIGS. 1, 2 and 3, a preferred embodiment of the present invention, adapted for use as a scraper, is illustrated, and is designated by the general reference numeral 20. The precise manner of construction and operation of the preferred embodiment will be fully described in later paragraphs. However, for greater clarity, the main components and general manner of operation of the preferred embodiment will be first described.

The scraper 20 comprises three main components, namely, a manually grippable housing 22 having a cartridge receiving chamber 30 defined therewithin, a blade cartridge 32 releasably retained within the cartridge receiving chamber 30, and a transport mechanism 42 mounted on the housing 22 for sliding movement between forward, intermediate and rearmost positions to control movement of a selected scraping blade 40', with each said position being shown in FIGS. 1,2 and 3 respectively. The housing 22 has a blade chase 28 formed adjacent a forward end 24 of the housing 22 to accommodate operative positioning of the selected blade 40'. The blade cartridge 32 contains a plurality of blades 40, with the selected one 40' of the plurality of blades 40 in aligned registry with the blade chase 28. Positioning of the transport mechanism 42 at the forward position causes (in a manner which will explained in more detail below) the selected blade 40' to be carried by the transport mechanism 42 from the blade cartridge 32 to project in an operative position from the blade chase 28 so as to present a first sharpened edge 40B of said selected blade 40' for use, as shown in FIG. 1. Sliding rearward movement of the transport mechanism 42 from the forward position to the intermediate position shown in FIG. 2 causes the selected blade 40' to be retracted into the blade cartridge 32, and sliding rearward movement of the transport mechanism 42 from the intermediate position to the rearmost position, which is fully rearwardly removed from the blade cartridge 32 and shown in FIG. 3, causes the transport mechanism 42 to disengage from the selected blade 40'. Such rearward removal of the transport mechanism 42 from the blade cartridge 32 permits (in a manner which will be described in more detail later) movement of the blade cartridge 32, relative to the housing 22, along a transverse axis "B", for alignment of another one of the plurality of blades 40 with the blade chase 28 for use, when the selected blade 40' has become worn, and for removal of the blade cartridge 32 for the exchange thereof, as shown in FIG. 3, when each of the plurality of blades 40 in the blade cartridge 32 have become worn.

The precise manner of construction and operation of the preferred embodiment of the cutting/scraping tool 20 of the present invention will now be more fully described.

In this regard, with particular reference to FIGS. 1,2 and 3, the housing 22 will be seen to define a longitudinal axis "A". The housing 22 has a head portion 22A adjacent the forward end 24 thereof and a handle portion 22B adjacent a rearward end 26 thereof. The aforesaid blade chase 28 is formed in the head portion 22A of the housing, and is aligned with the longitudinal axis "A". In the preferred embodiment shown, the cartridge receiving chamber 30 passes substantially transversely through the housing 22, and defines the aforementioned transverse axis "B".

Figure 20:
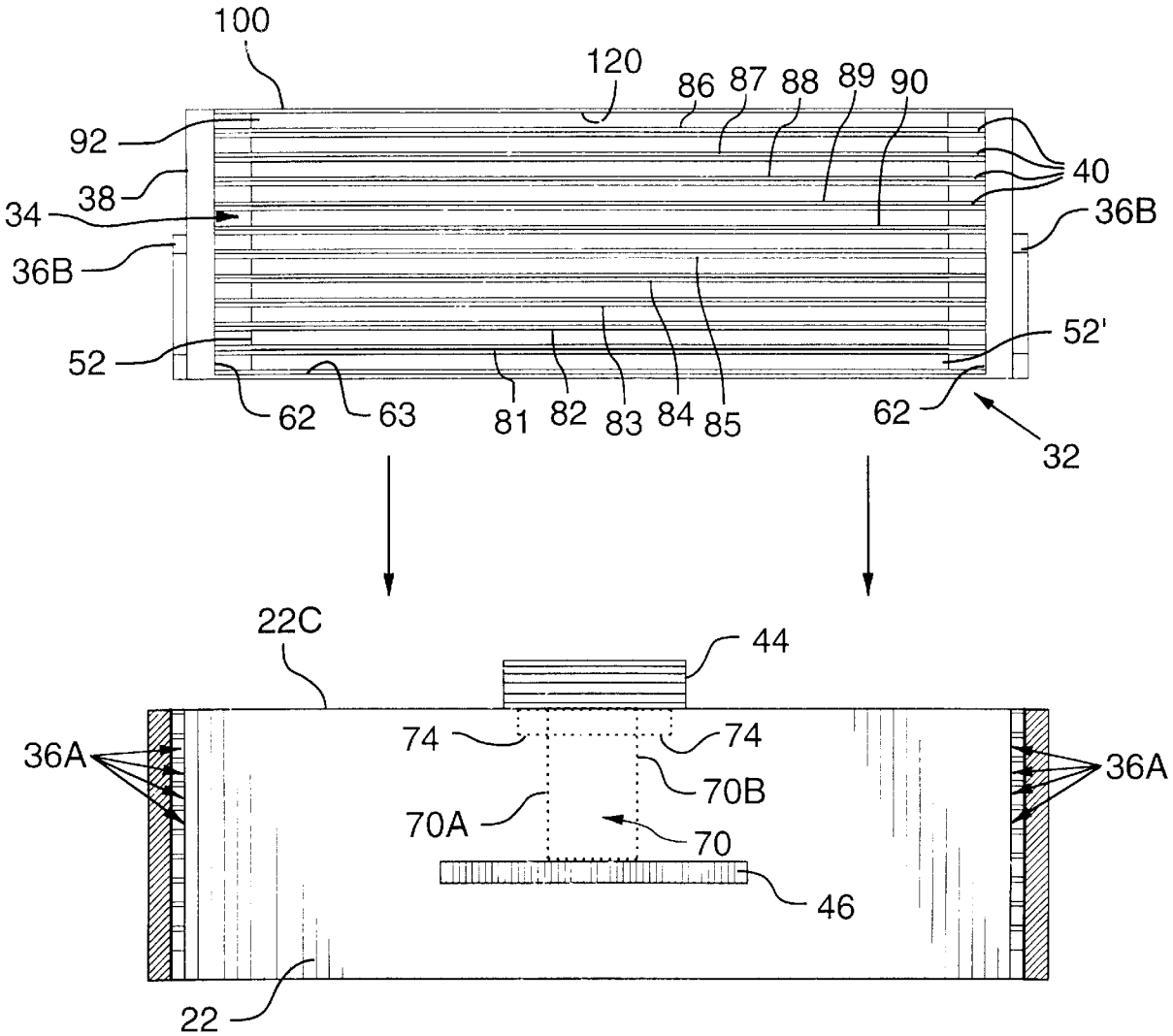
FIG. 20 is a cross-sectional view of the cutting/scraping tool of FIG. 5, along sight line 20—20 of FIG. 5, and a front elevational view of the blade cartridge shown in FIG. 3 about to be inserted into the cutting/scraping tool.
Figure 21:
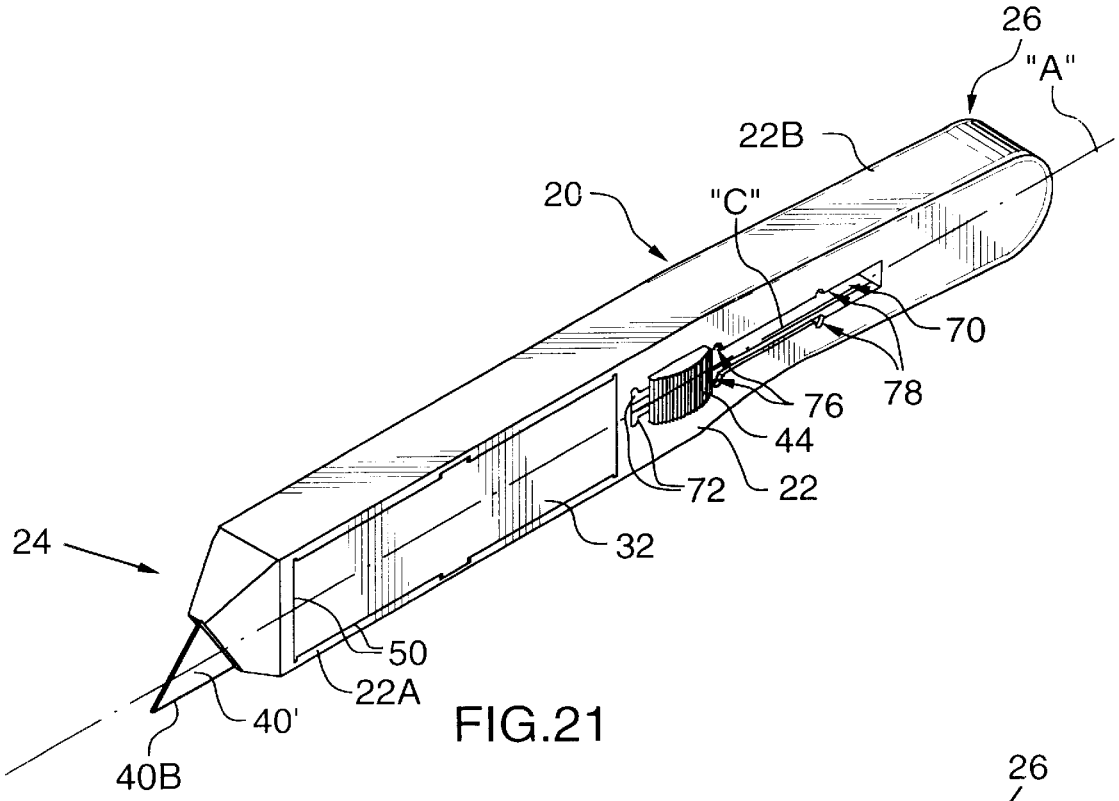
FIG. 21 is a perspective view of a cutting/scraping knife according to a first alternative embodiment of the present invention, showing the transport mechanism at the forward position and a selected blade at the operative position.
Figure 22:
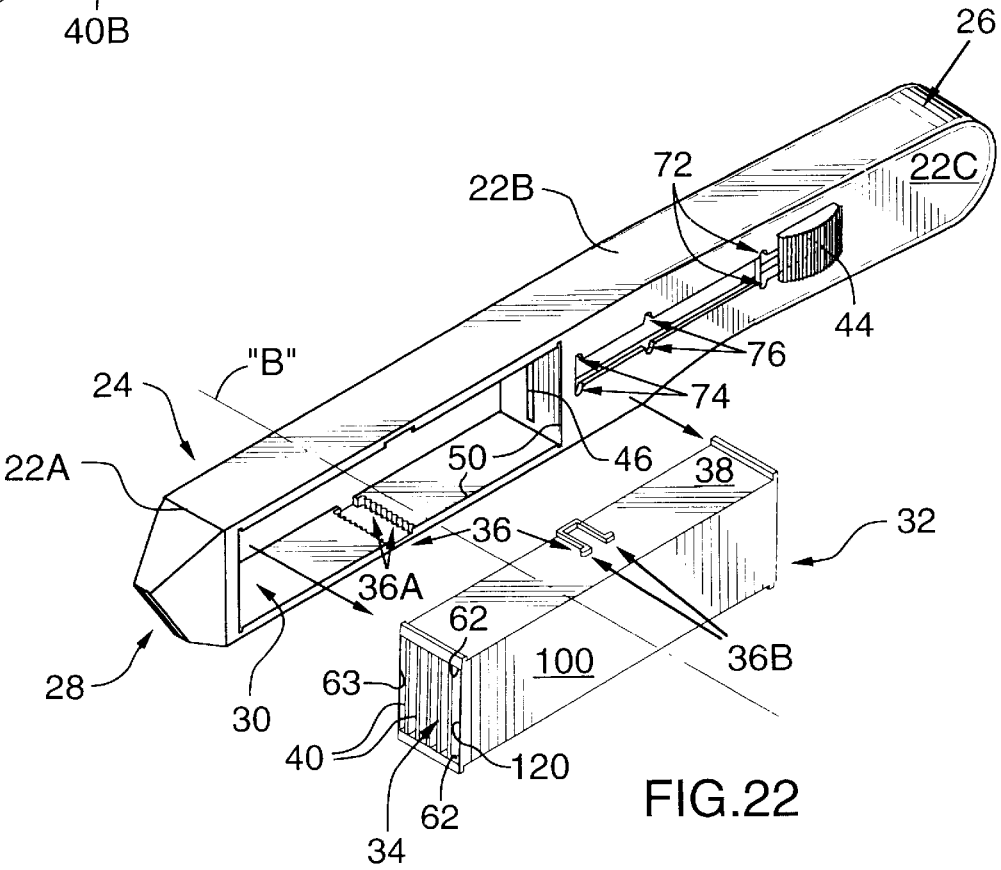
FIG. 22 is a view similar to FIG. 21, with the transport mechanism shown at the rearmost position and the blade cartridge transversely removed from the cartridge receiving chamber.
Figure 23:
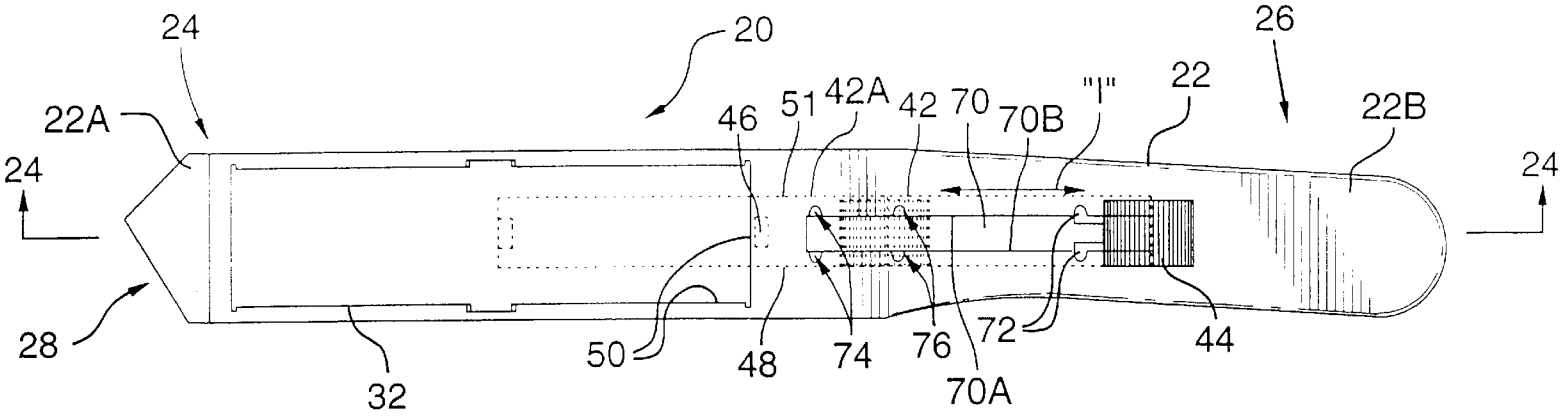
FIG. 23 is a side elevational view of the cutting/scraping tool of FIG. 21, with the transport mechanism being shown in phantom outline at the forward position.
Figure 24:
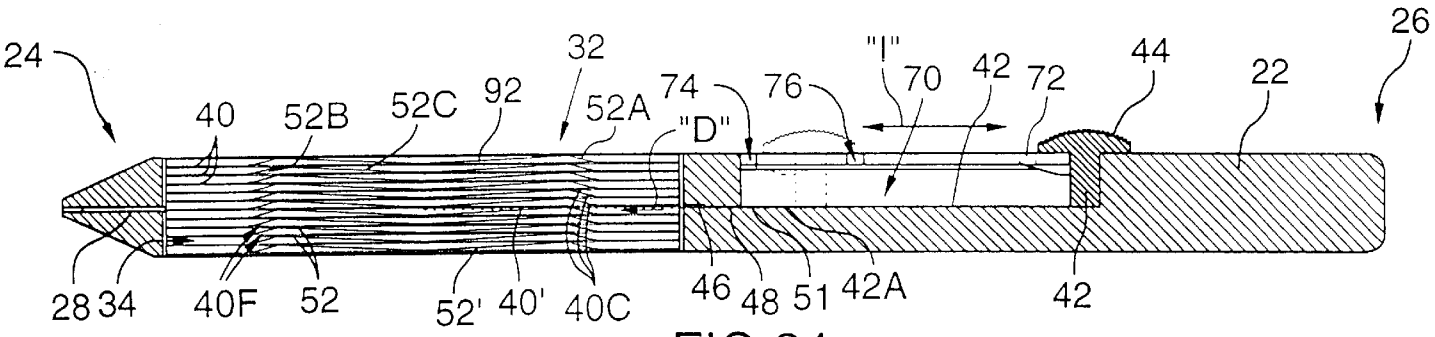
FIG. 24 is a cross-sectional view of the cutting/scraping tool of FIG. 23 along sight line 24-24 of FIG. 23.
Figure 25:
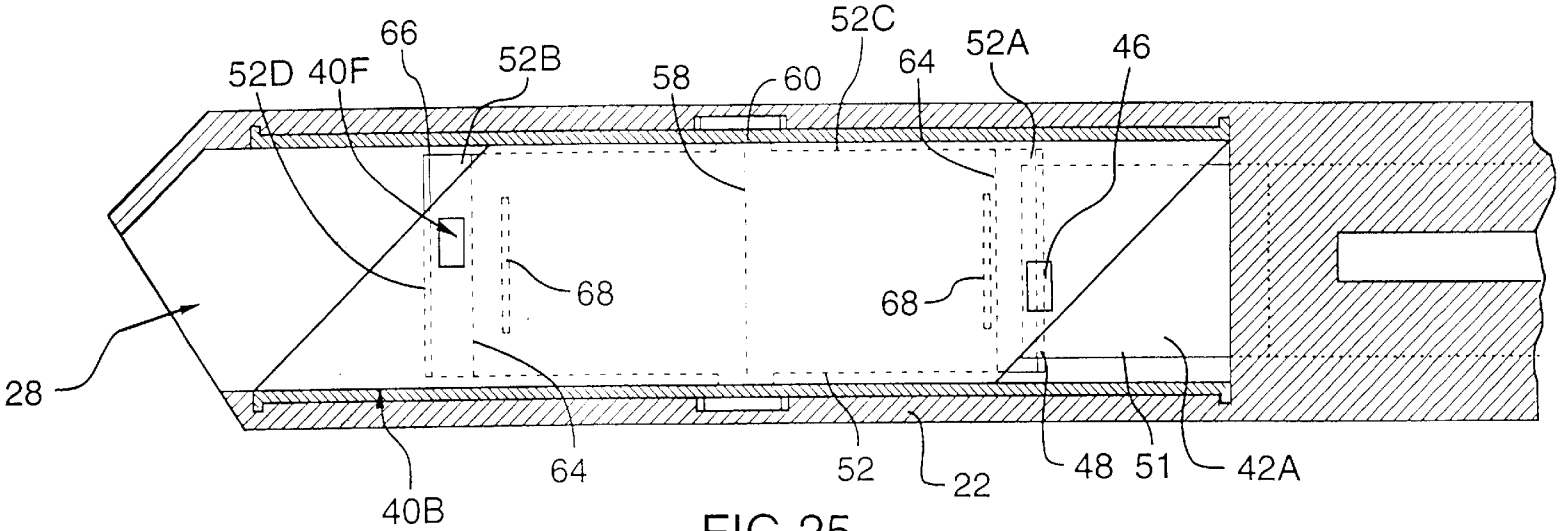
FIG. 25 is an enlarged side partial cutaway view of the cutting/scraping tool of FIG. 23, showing the transport mechanism at the intermediate position and the selected blade at the loading position.
Figure 26:
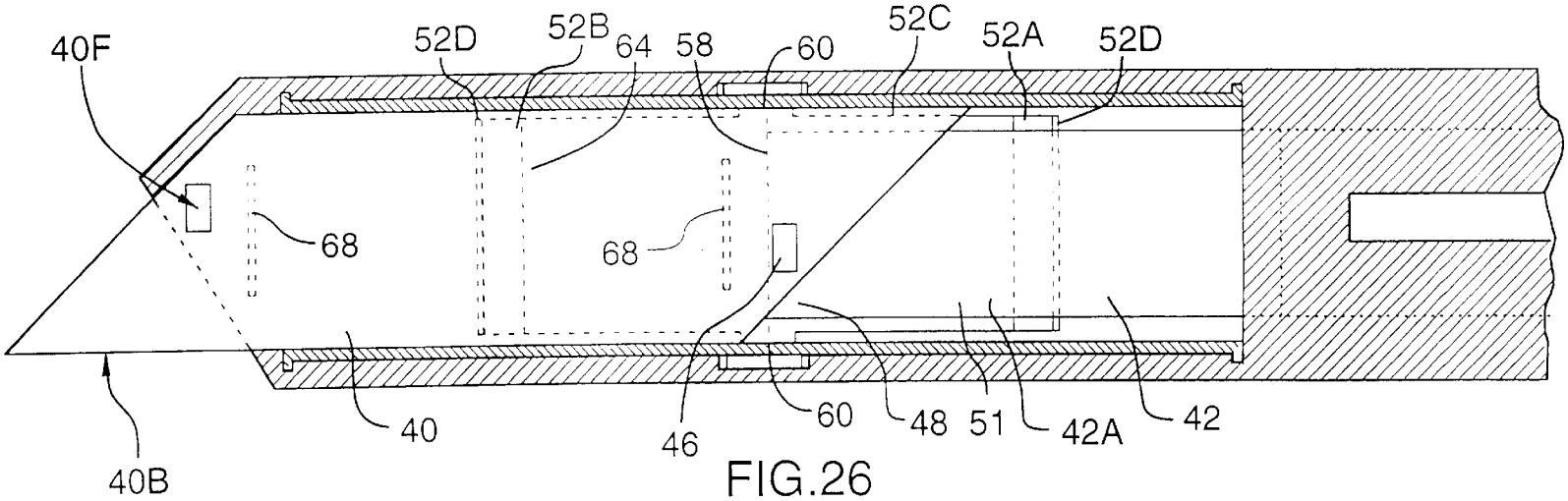
FIG. 26 is a view similar to FIG. 25, showing the transport mechanism at the forward position and the selected blade at the operative position.

As best seen in FIG. 20, the blade cartridge 32 takes the form of an open ended sleeve, having inner side surfaces 62, a lower floor surface 63 and an upper ceiling surface 120 which together define a slot 34 of rectangular cross-section. In the preferred embodiment illustrated, ten blades 40 are positioned within the slot 34 of the blade cartridge 32 in vertically stacked, spaced, substantially parallel relation, said blades 40 being interleaved between eleven deflector means 52 which are each fixedly positioned within the slot 34, each deflector means 52 having an inclined ramp portion 52A thereof. A lowermost of the blades 40 defines a first blade, and is designated by numeral 81. A second of the blades 40 is stacked upon the first blade 81, and is designated by numeral 82, with third, fourth, fifth, sixth, seventh, eighth, ninth and tenth of the blades 40 being similarly sequentially stacked upon the first blade 81, and being designated, respectively, by numerals 83, 84, 85, 86, 87, 88, 89 and 90.

Figure 11:
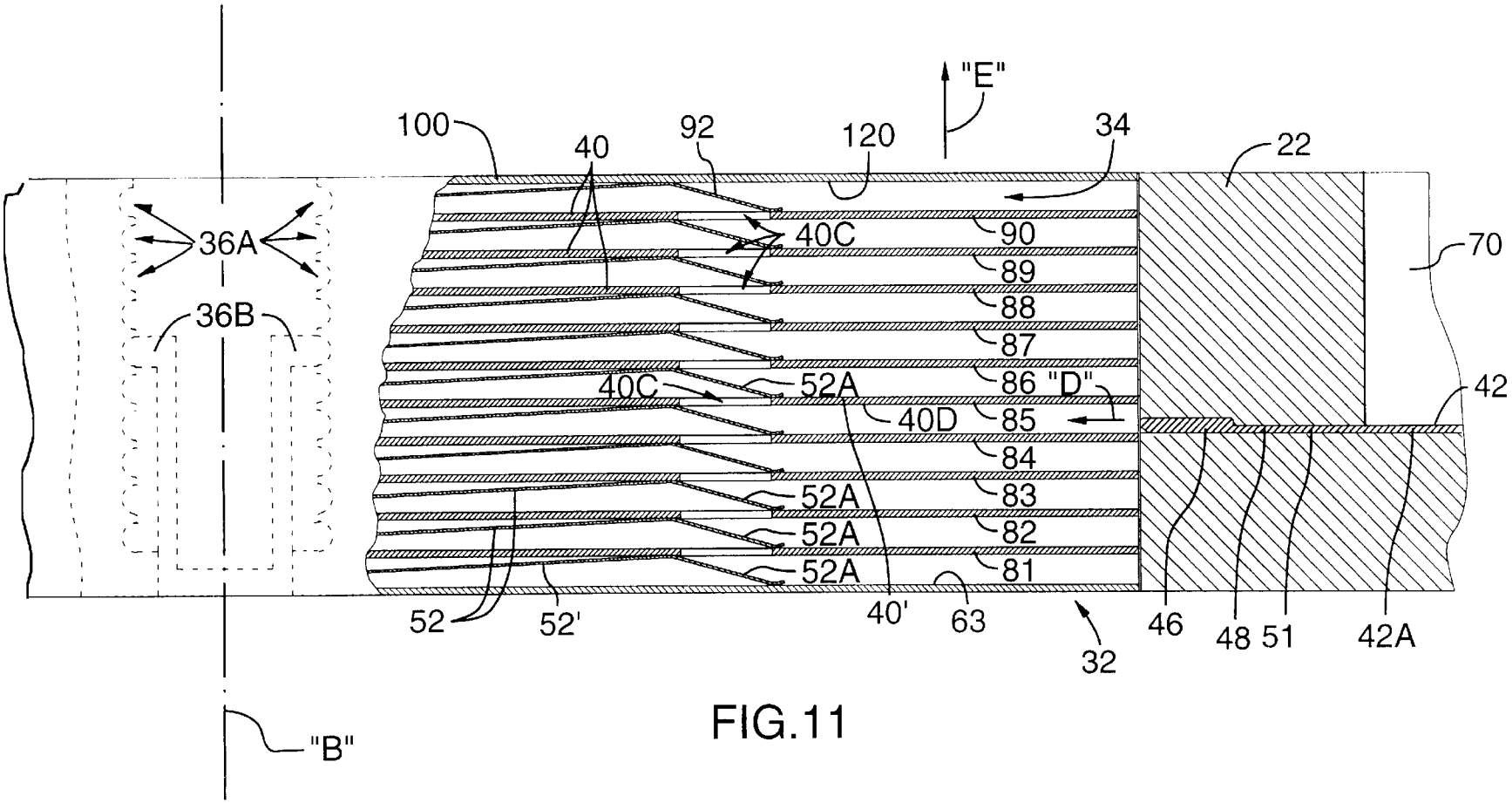
FIG. 11 is a partial cutaway cross-sectional view of the cutting/scraping tool of FIG. 4 along sight line 11—11 of FIG. 4, with the detent lugs and detent recesses of the cartridge positioning means shown in phantom outline.
Figure 12:
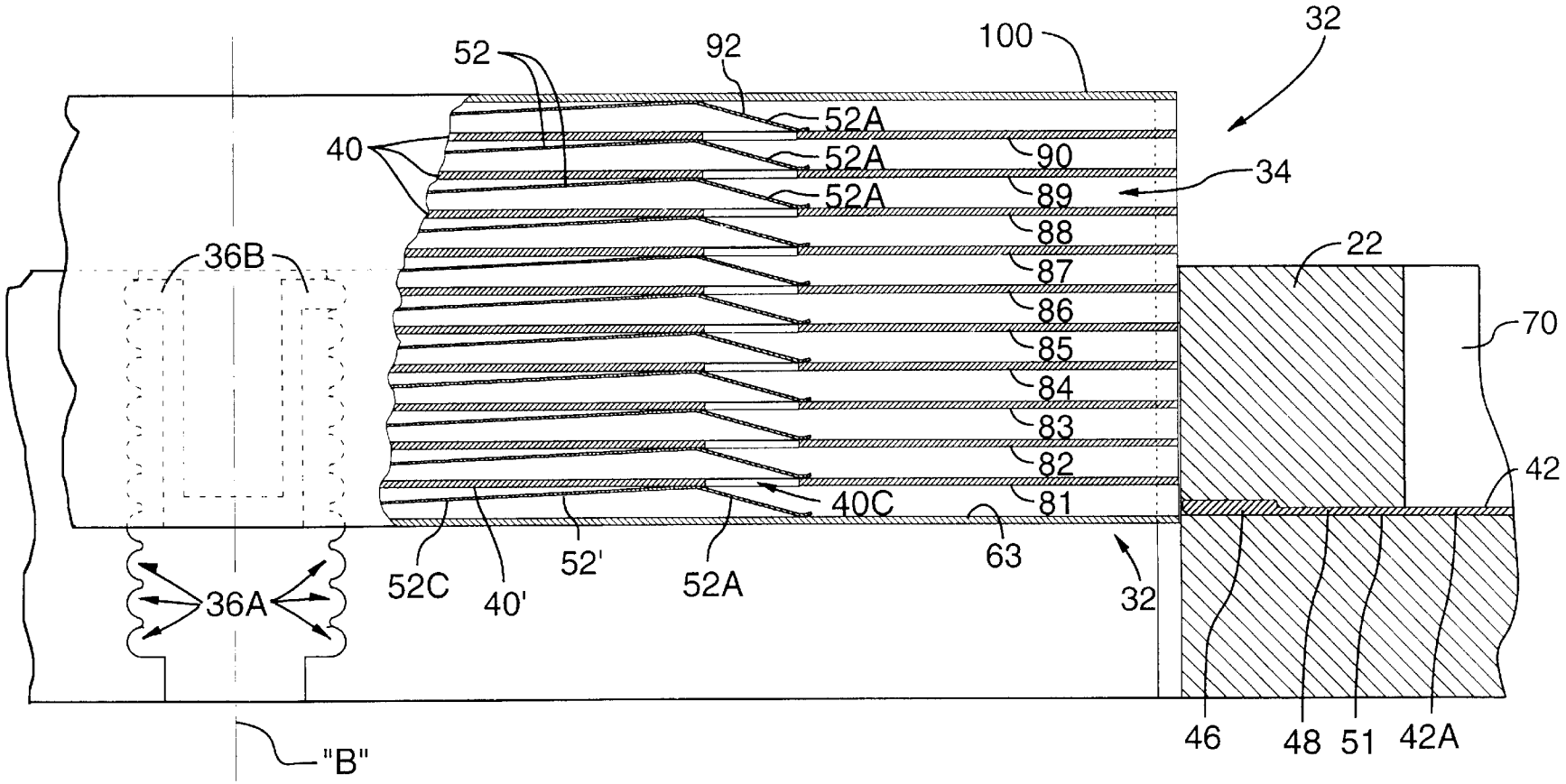
FIG. 12 is a view similar to FIG. 11, with the blade cartridge moved upwardly along the transverse axis.

The blade cartridge 32 is releasably retained as aforesaid in the cartridge receiving chamber 30 by cartridge positioning means 36. The cartridge positioning means 36 is adapted such that, when the transport mechanism 42 is in the rearmost position, as illustrated in FIG. 3, the blade cartridge 32 is selectively movable along the transverse axis "B", so as to position a respective one of the blades 40 in aligned registry with the blade chase 28 so as to define a loading position, said respective one of the blades 40 defining the aforementioned selected blade 40'. Said movement of the blade cartridge 32 is most clearly illustrated in FIGS. 11 and 12. FIG. 11 illustrates the blade cartridge 32 operatively positioned in the cartridge receiving chamber 30 in the housing 22, with the transport mechanism 42 at the rearmost position, the detent means 46 being rearwardly removed from the blade cartridge 32, operatively beneath the fifth blade 85. Movement of the blade cartridge 32 along the transverse axis "B" in the direction indicated by arrow "E" in FIG. 11 results in the blade cartridge 32 being positioned such that the detent means 46 is operatively beneath the first blade 81, as shown in FIG. 12, for subsequent carriage of the first blade 81 into the operative position by the transport mechanism 42.

Figure 4:
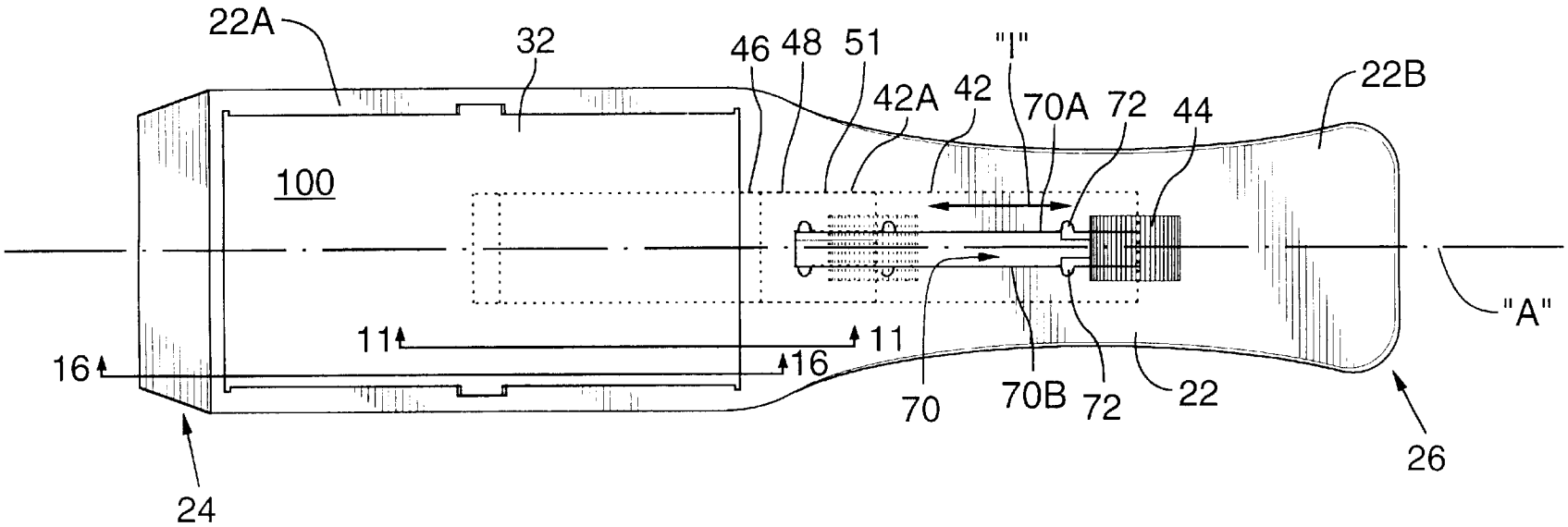
FIG. 4 is a top plan view of the cutting/scraping tool of FIG. 1, shown with the manually engageable actuator of the transport mechanism at the rearmost position in solid outline, and in phantom outline at the forward position.
Figure 5:
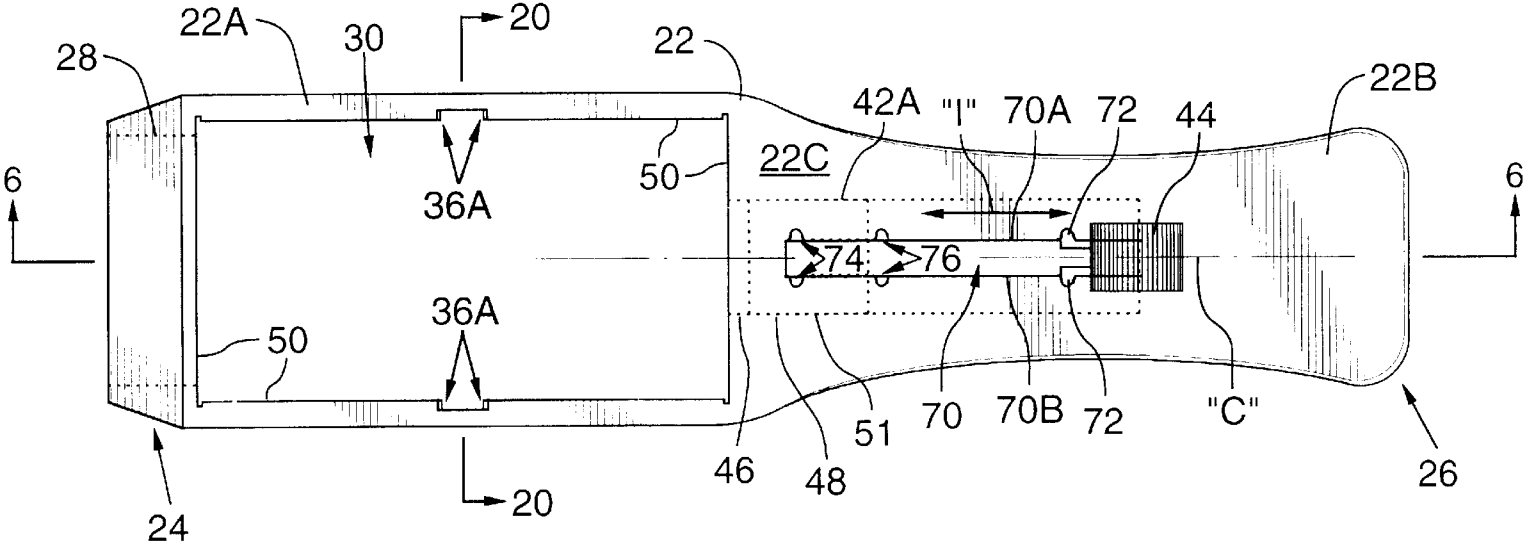
FIG. 5 is a top plan view of the cutting/scraping tool of FIG. 3, shown with the blade cartridge removed.
Figure 6:
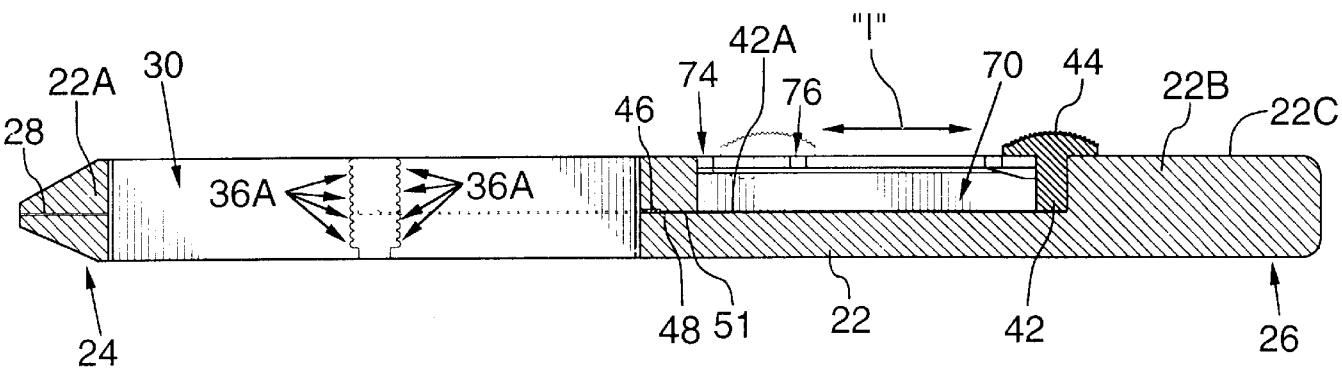
FIG. 6 is a cross-sectional view of the cutting/scraping tool of FIG. 5, along sight line 6—6 of FIG. 5.

The aforementioned transport mechanism 42 is mounted on the housing 22 for sliding movement along an axis "C" substantially parallel to the longitudinal axis "A" between the forward, intermediate and rearmost positions the direction of such movement being indicated by arrow "I" in FIGS. 4, 5 and 6. It will be evident that in the preferred embodiment illustrated, axis "C" is coincident with longitudinal axis "A", although this is not essential. The transport mechanism 42 preferably comprises a flexible, resilient forwardly-directed tongue portion 42A, and a manually engageable actuator 44 projecting from the housing 22 to effect said sliding movement of the transport mechanism 42. A blade engaging detent means 46, adapted for carrying engagement with a respective one of the blades 40 is also provided, and is positioned within the housing 22 adjacent a forward end 48 of the transport mechanism 42. In the preferred embodiment illustrated, each blade 40 has a first socket means 40C, namely, an opening projecting through an underside 40D thereof, and the blade engaging detent means comprises an upwardly projecting tab member 46, integrally formed with the tongue portion 42A adjacent a forward end 51 thereof, said tab member 46 being sized and proportioned to frictionally engage a respective one of said first socket means 40C.

As best seen in FIGS. 2, 5 and 20, the actuator 44 slides in a channel 70 which longitudinally extends along an upper surface 22C of the housing member 22 so as to define axis "C". Conventional laterally compressible teeth members 72 are also provided, which frictionally engage corresponding stop detent recesses 74,76,78 on respective lateral sides 70A and 70B of the channel 70, so as to selectively lock the transport mechanism 42, in the forward, intermediate and rearmost position, respectively. The manner of mounting the actuator 44 in the channel 70, and the construction of the laterally compressible teeth members 72 and stop detent recesses 74,76,78, as incorporated in the preferred embodiment of the present invention, is well known to persons skilled in the art and does not form part of the present invention.

Figure 13:
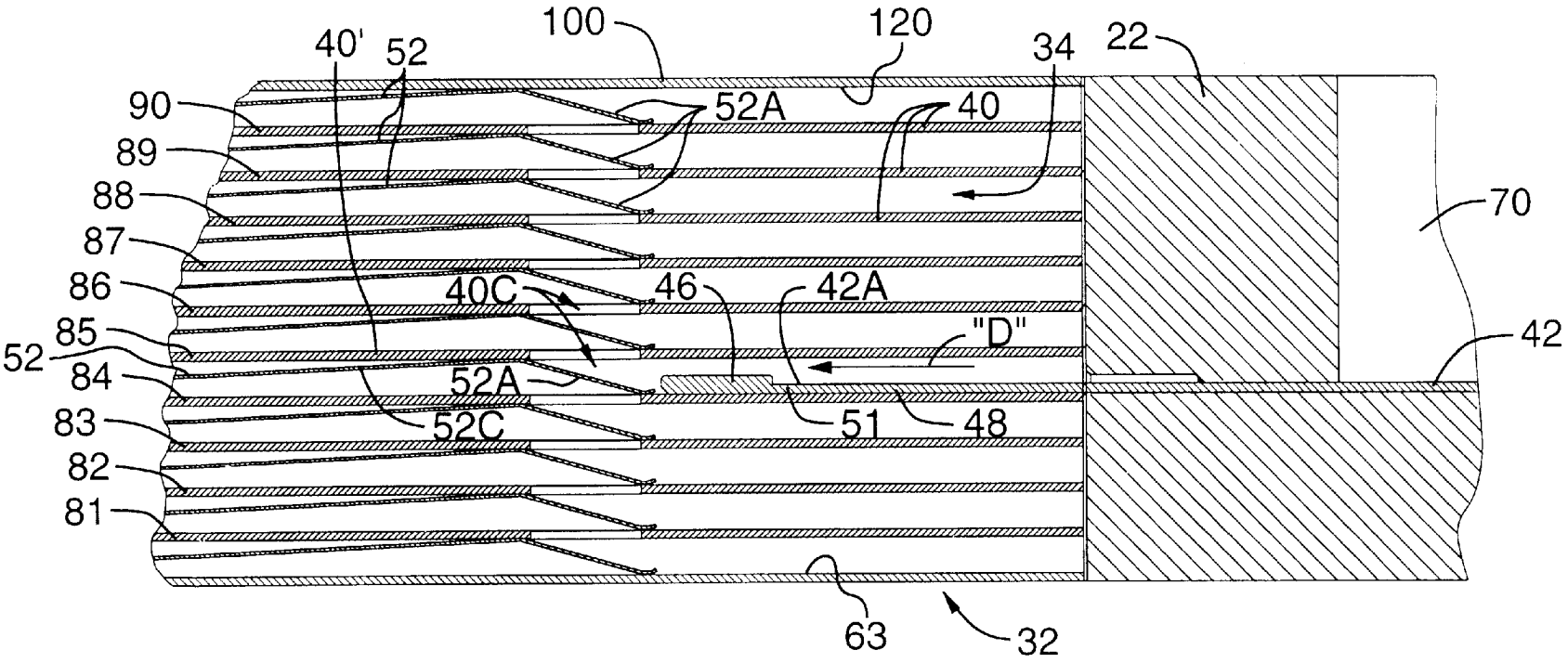
FIG. 13 is a view similar to FIG. 11, with the transport mechanism forwardly disposed from the rearmost position.
Figure 14:
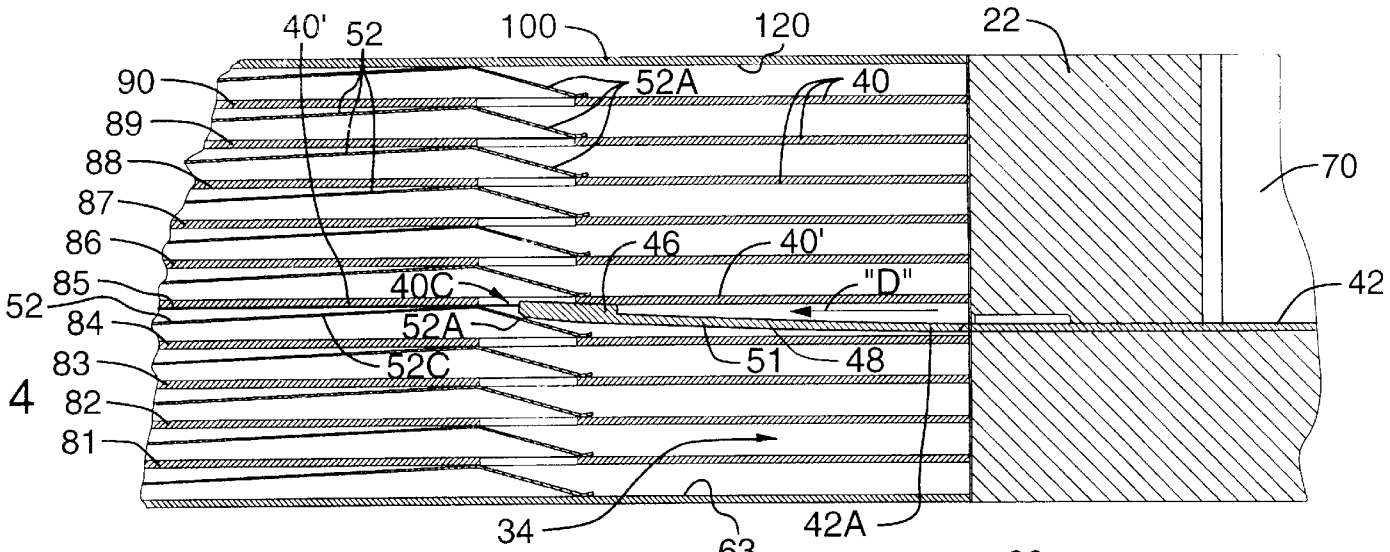
FIG. 14 is a view similar to FIG. 13, with the transport mechanism further forwardly disposed, with the tongue portion partially deflected against the inclined ramp portion of the deflector means beneath the selected blade.
Figure 15:
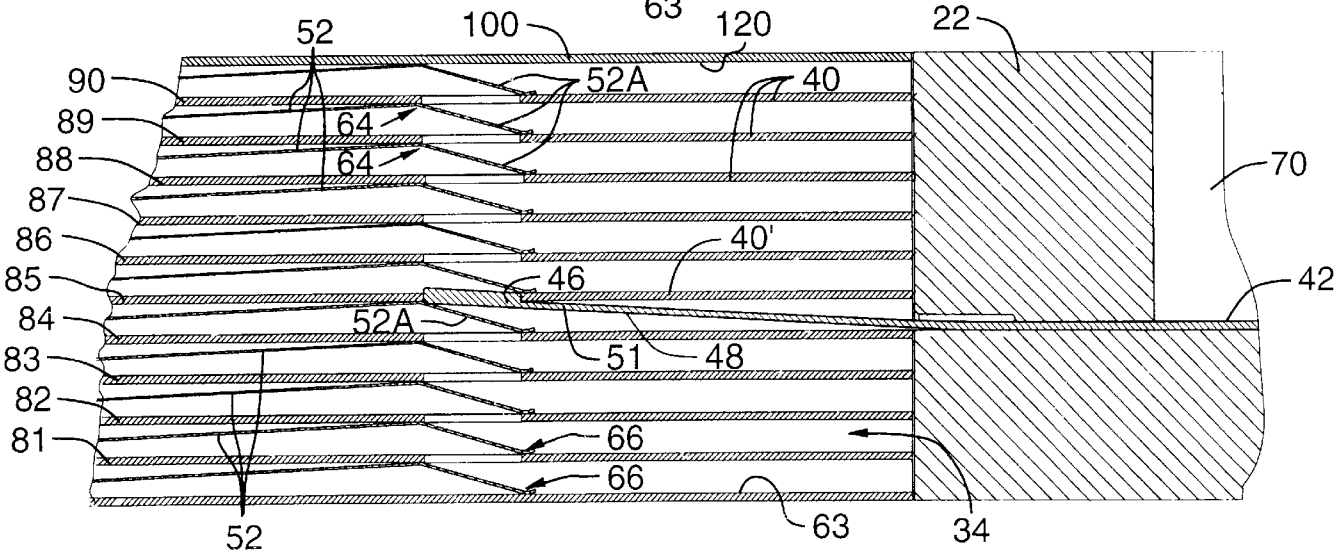
FIG. 15 is a view similar to FIG. 14, with the transport mechanism at the intermediate position, with the tongue portion further deflected against the inclined ramp portion of the deflector means and with the tab member in carrying engagement with the socket means of the selected blade.

The cutting/scraping tool 20 of the present invention will now be described in operation with particular reference to FIGS. 11 through 17. The transport mechanism 42 is shown in the rearmost position in FIG. 11, and in the intermediate position in FIGS. 15 and 16. In operation, during movement of the transport mechanism 42 from the rearmost position to the intermediate position, the detent means 46 enters the blade cartridge 32 in a direction substantially parallel to the longitudinal axis "A" beneath the selected blade 40', said direction being denoted by arrow "D" in FIG. 11, and is deflected upwardly by the inclined ramp portion 52A of the deflector means 52 beneath the selected blade 40', as shown in FIGS. 13 and 14, to carryingly engage the first socket means 40C in the underside 40D of the selected blade 40', for subsequent carriage of the selected blade 40' by the detent means 46 to the operative position, shown in FIG. 17. Similarly, upon movement of the transport mechanism 42 from the intermediate position shown in FIGS. 15 and 16 to the rearmost position shown in FIG. 11, the detent means 46 disengages from the selected blade 40' when the selected blade 40' is at the loading position, in the blade cartridge 32 and removed from and in aligned registry with the blade chase 28.

Figure 10:
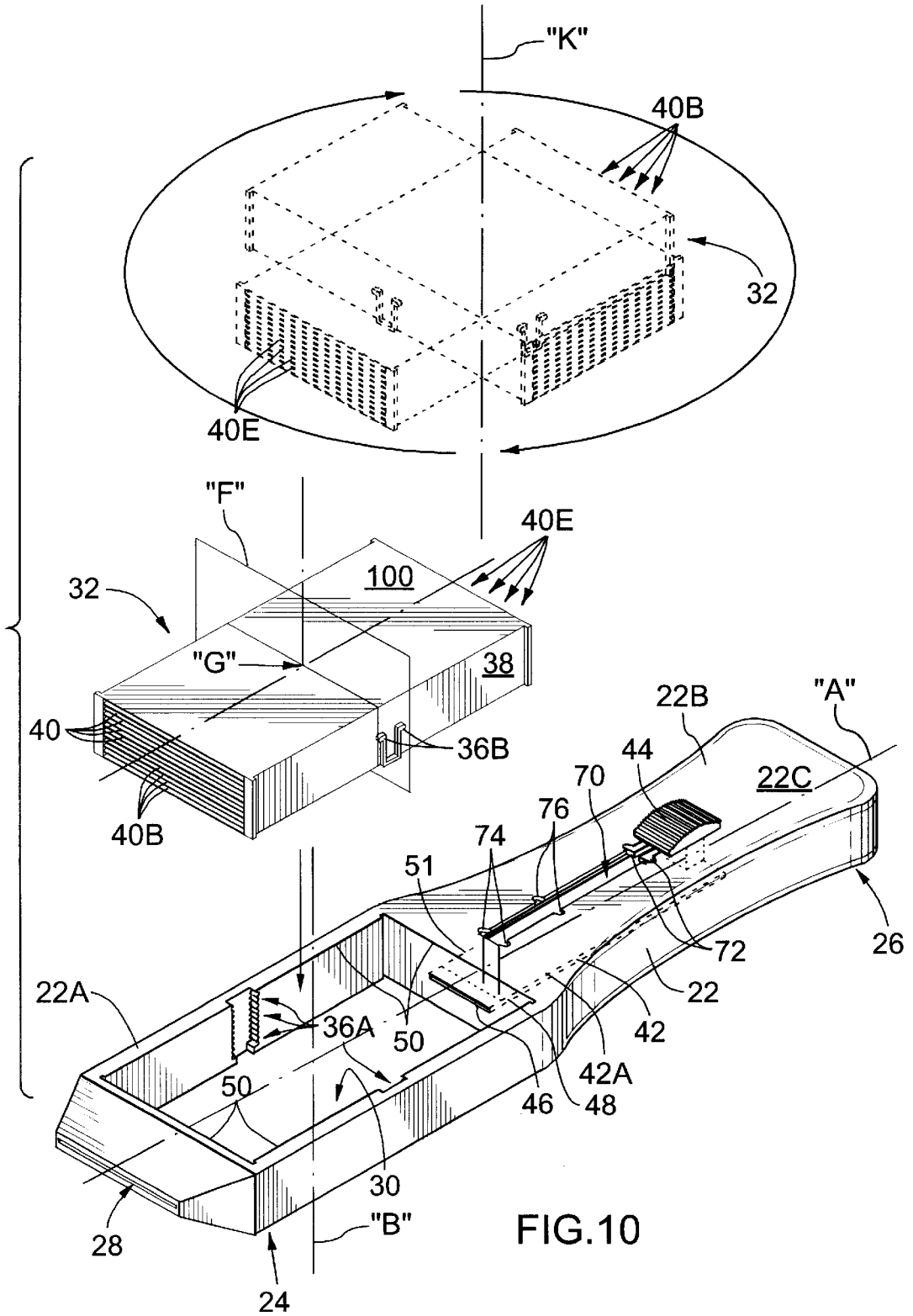
FIG. 10 is a perspective view of the cutting/scraping tool of FIG. 3, showing the blade cartridge removed for 180° rotation, such rotation being shown in phantom outline.
Figure 16:
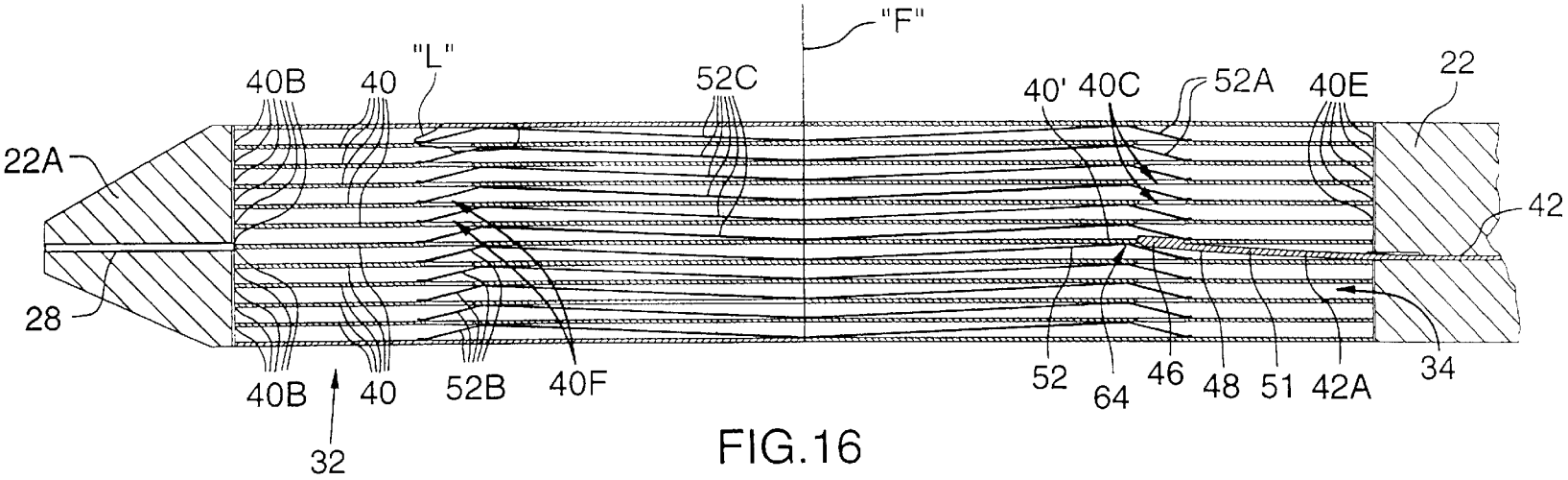
FIG. 16 is a partial side cross-sectional view of the cutting/scraping tool of FIG. 4 along sight line 16-16 of FIG. 4, with the transport mechanism at the intermediate position and the fifth blade from the bottom at the loading position.
Figure 17:
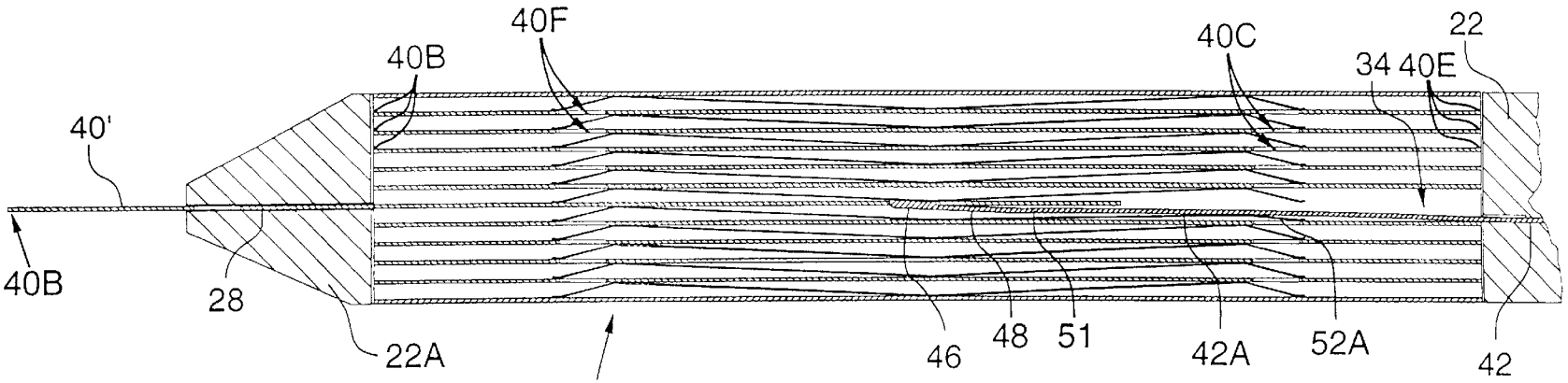
FIG. 17 is a view similar to FIG. 16, with the transport mechanism at the forward position, and the fifth blade from the bottom at the operative position.
Figure 18:
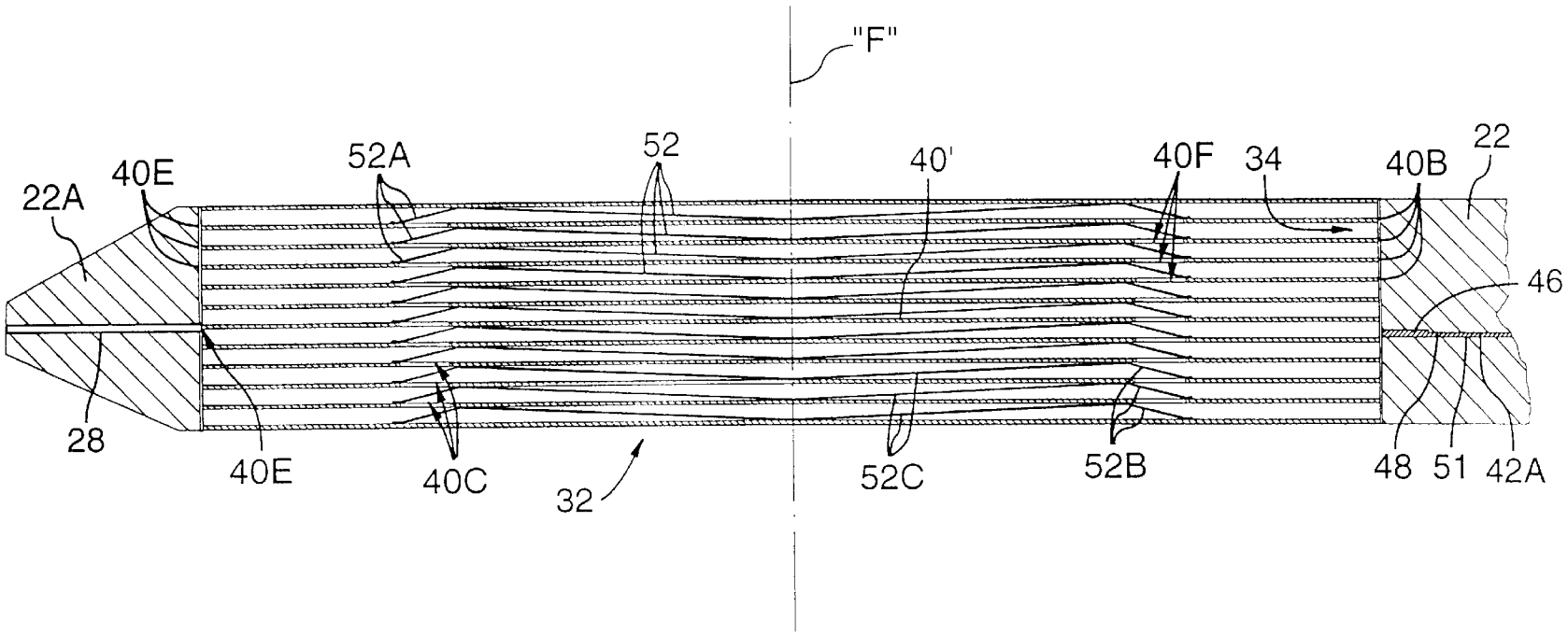
FIG. 18 is a view similar to FIG. 16, with the blade cartridge shown in a second rearwardly-directed orientation.

A further feature of the preferred embodiment is that, for greater economy, the blades 40 each comprise a second sharpened edge 40E rearwardly longitudinally disposed from the first sharpened edge 40B of each said blade 40 as shown in FIGS. 16 and 17. To permit selection as aforesaid of the second sharpened edges 40E for use, a second socket means 40F is also provided for each blade 40, and a declined ramp portion 52B is also provided for each deflector means 52, said second sharpened edges 40E, second socket means 40F and declined ramp portions 52B being arranged, as shown in FIG. 10, with relation to a plane "F", normal to the longitudinal axis "A" and extending through an axial midpoint "G" of the blade cartridge 32, in transverse symetry with the first sharpened edges 40B, first socket means 40C and inclined ramp portions 52A, as shown in FIGS. 10 and 16. As well, the cartridge positioning means 36 is further adapted to selectively releasably retain the blade cartridge 32 in a first forwardly-directed orientation, and a second rearwardly-directed orientation. In the first forwardly-directed orientation, the first sharpened edges 40B are forwardly disposed from the second sharpened edges 40E, for presentation of the first sharpened edge 40B of the selected blade as aforesaid. In the second rearwardly-directed orientation, the second sharpened edges 40E are forwardly disposed from the first sharpened edges 40B, as shown in FIG. 18. Accordingly, when the first sharpened edges 40B have been worn, the blade cartridge 32 may be removed from the cartridge receiving chamber 30, rotated 180° about a vertical axis "K", as shown in FIG. 10, and operatively re-positioned in the cartridge receiving chamber 30 in the second rearwardly-directed orientation, for subsequent carriage of the selected blade 40' by the transport mechanism 42 to the operative position, so as to present the second sharpened edge 40E of said selected blade 40' for use.

To effect adjustable releasable retention of the blade cartridge 32, the cartridge positioning means 36 may comprise a first portion, being a plurality of detent recesses 36A positioned on the housing 22 adjacent a perimeter 50 of the cartridge receiving chamber 30 and a second portion, being a plurality of complementary lugs 36B extending laterally from an outer surface 38 of the blade cartridge 32 and adapted to frictionally engage said detent recesses 36A in an adjustable plurality of configurations.

Figure 7:
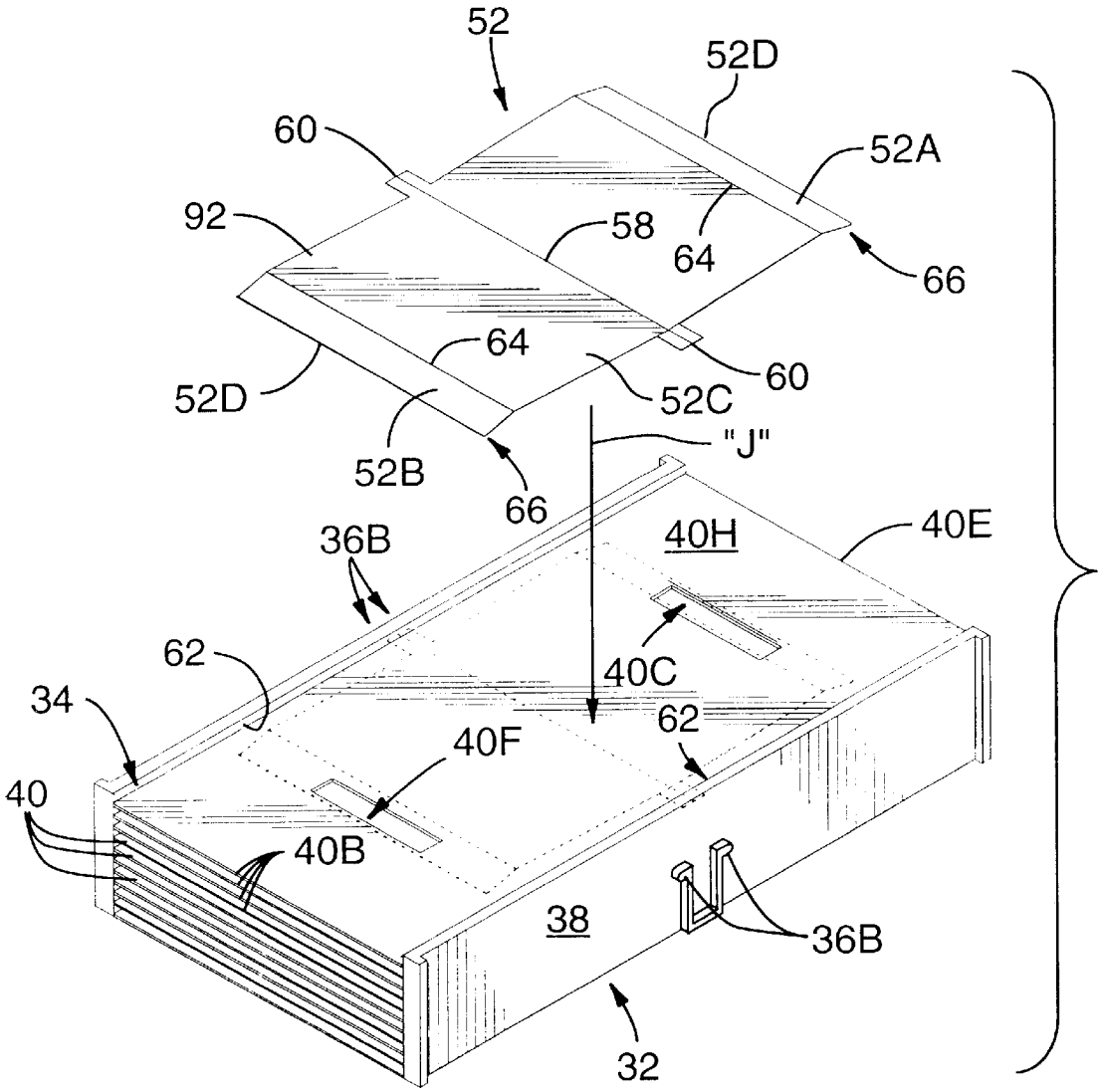
FIG. 7 is a top perspective view of the blade cartridge of FIG. 1, with the top surface of the blade cartridge removed for clarity.

In another aspect of the present invention, the inclined ramp portion 52A and declined ramp portion 52B of each deflector means 52 are joined by a respective one of a plurality of substantially V-shaped portions 52C, as shown in FIG. 16. As best seen in FIG. 7, each V-shaped portion 52C has a lower ridge 58 and laterally spaced side edges 60. In the preferred embodiment shown, the laterally spaced side edges 60 are rigidly connected to respective inner side surfaces 62 of the blade cartridge 32 by conventional connection means, such as adhesive (not shown). The blades 40 and deflector means 52 are arranged in vertically stacked abutting relation, with a deflector means 52 beneath each blade 40, and atop each blade 40. Accordingly, the rigid connection of the side edges 60 of the V-shaped portions 52C to the inner side surfaces 62 serves both to fixedly position said deflector means 52 in the slot 34 in the blade cartridge 32 as aforesaid, and also to support the blades 40 in said vertically stacked, spaced, substantially parallel relation. For clarity, the blade cartridge 32 is shown in FIG. 7 with the top surface 100 of the blade cartridge 32 removed, and an uppermost 92 of the deflector means is shown apart from the remainder of the blade cartridge 32, ready for insertion therein in the direction indicated by arrow "J" to its position in the preferred embodiment which is shown in phantom outline.

Figure 19:
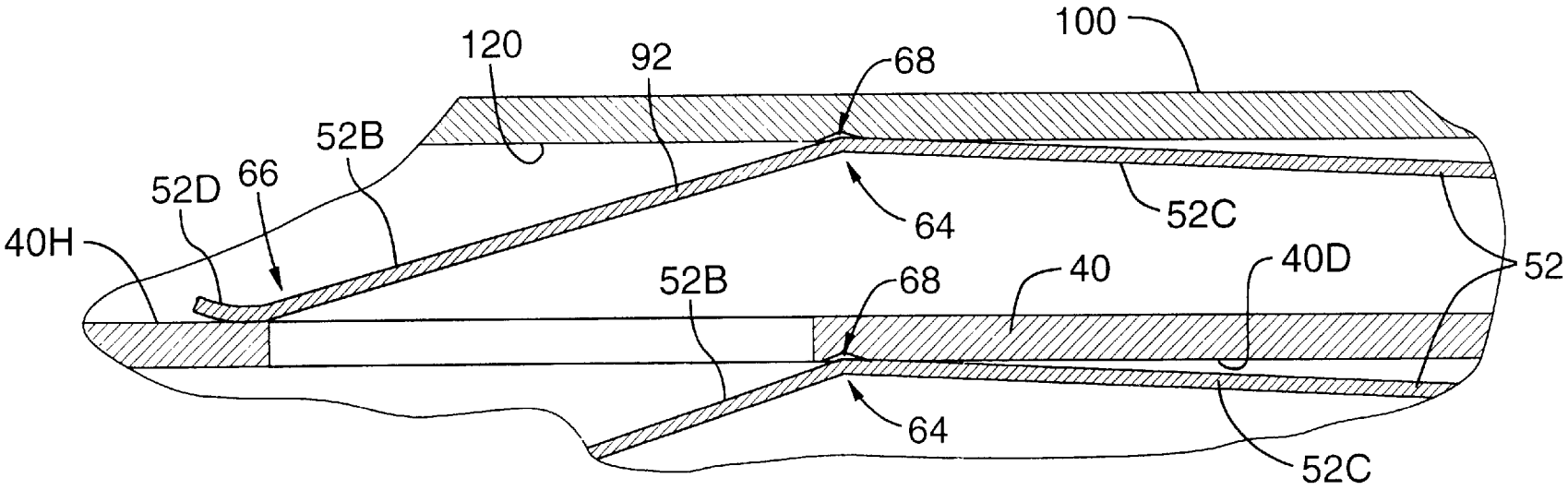
FIG. 19 in an enlarged partial cross-sectional view of the blade cartridge, taken from the circumscribed area "L" of FIG. 16.

It will be evident that in the preferred embodiment shown, no clearance is provided between the deflector means 52 and the blade members 40 so as to permit the tongue portion 42A to enter therebetween during carriage of the selected blade 40' to the operative position. Accordingly, the deflector means 52 are preferably constructed of a flexible and resilient material. In operation, during movement of the transport mechanism 42 between the rearmost position and the forward position, the detent means 46 is deflected upwardly by a respective one of the ramp portions 52A/52B, and an apex ridge 64 of said respective one of the ramp portions 52A/52B is compressed downwardly by the transport mechanism 42, to provide clearance for the tongue portion 42A to extend within the blade cartridge 32 for carriage of the selected blade 40', as illustrated in FIGS. 16 and 17. Such downward compression of the apex ridge 64 of said respective one of the ramp portions 52A/52B is preferably accomplished by longitudinal sliding translation of a base 66 of said ramp portion 52A/52B against an upper surface 40H of the blade 40 beneath said respective one of the ramp portions 52A/52B, and, in the context of a lowermost 52' of the deflector means 52, against the lower floor surface 63 of the blade cartridge 32. To assist such longitudinal sliding translation of the bases 66, each ramp portion 52A/52B is provided with, adjacent the base 66 thereof, an upturned lip portion 52D, as best seen in FIG. 19.

Figure 8:
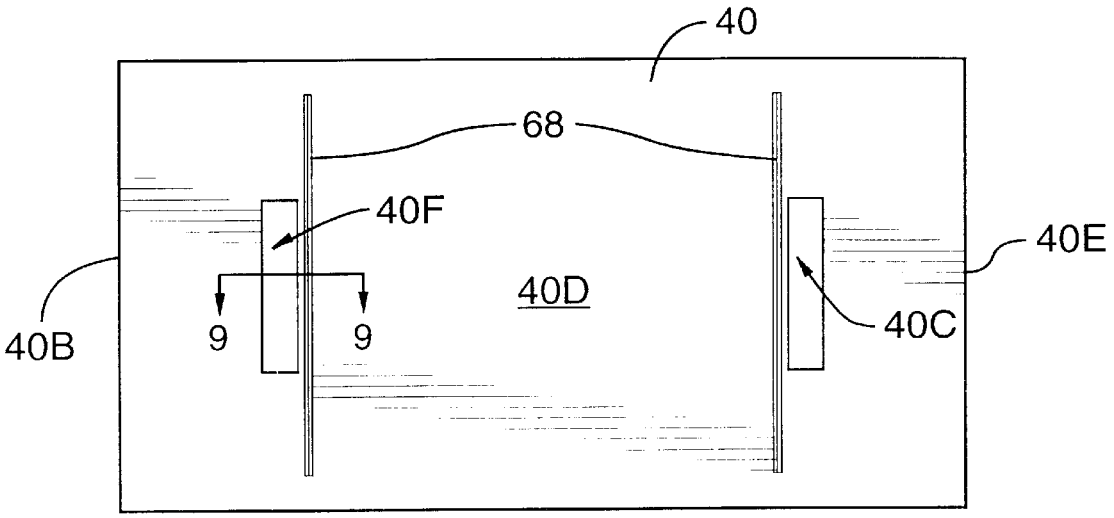
FIG. 8 is a bottom plan view of a blade according to the preferred embodiment of the present invention.
Figure 9:
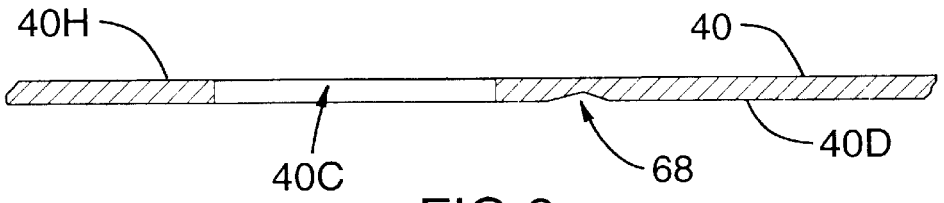
FIG. 9 is a partial cross-sectional view of the blade of FIG. 8, along sight line 9—9 of FIG. 8.

It will be appreciated that, in the preferred embodiment shown, the blades 40 are frictionally retained within the blade cartridge 32 by the deflector means 52 which frictionally engage same. For additional safety, in the preferred embodiment, the blades 40 each further comprise two laterally extending and longitudinally spaced grooves 68 on the underside 40D thereof, best seen in FIGS. 8, 9 and 19, said grooves 68 being adapted to releasably, frictionally receive the apex ridges 64 of the deflector means 52 abutting the underside 40D of said blade 40, so as to prevent inadvertent longitudinal translation of said blade 40 when the blade cartridge 32 is not positioned within the cartridge receiving chamber 30, such as is the case, for example, during cartridge rotation as shown in FIG. 10. It will be understood that said grooves 68 are dimensioned and adapted for the operative release of the selected blade 40' for carriage by the detent means 46 as aforesaid.

It should also be noted that, in the preferred embodiment shown in FIGS. 1–20, the first sharpened edge 40B and second sharpened edge 40E of the selected blade 40' are oriented horizontally and substantially normal to the longitudinal axis "A" of the housing 22 when the selected blade 40' is at the operative position, and the housing 22 is shaped and dimensioned for ergonomic comfort for substantially horizontal movement of the cutting/scraping tool 20, so as to provide same with particular utility in relation to scraping operations. However, it will be appreciated that the teachings of the present invention may be applied in a first alternative embodiment of the cutting/scraping tool 20, wherein the first sharpened edge 40B and second sharpened edge 40E of the selected blade 40' are oriented horizontally and substantially parallel to the longitudinal axis of the housing when the selected blade 40' is at the operative position, wherein the plane of the selected blade 40' is oriented substantially vertically, and wherein the housing 22 is shaped and dimensioned for ergonomic comfort for substantially vertical movement of the cutting/scraping tool, as illustrated in FIGS. 21 through 26, so as to provide the cutting/scraping tool 20 with particular utility in relation to cutting operations. The manner of construction and operation of the first alternative embodiment, shown in FIGS. 21 through 26, is substantially identical to that of the preferred embodiment, except for the aforementioned difference in orientation of the sharpened edges 40B and 40E and the routine re-configuration of the remaining elements of the tool 20 to accommodate this change. Accordingly, for the sake of brevity, such construction and operation will not be repeated. It will, however, be readily understood by those skilled in the art that the description of the preferred embodiment also applies to the alternative embodiment, with analogous components being given like reference numerals in FIGS. 21 through 26.

Figure 27:
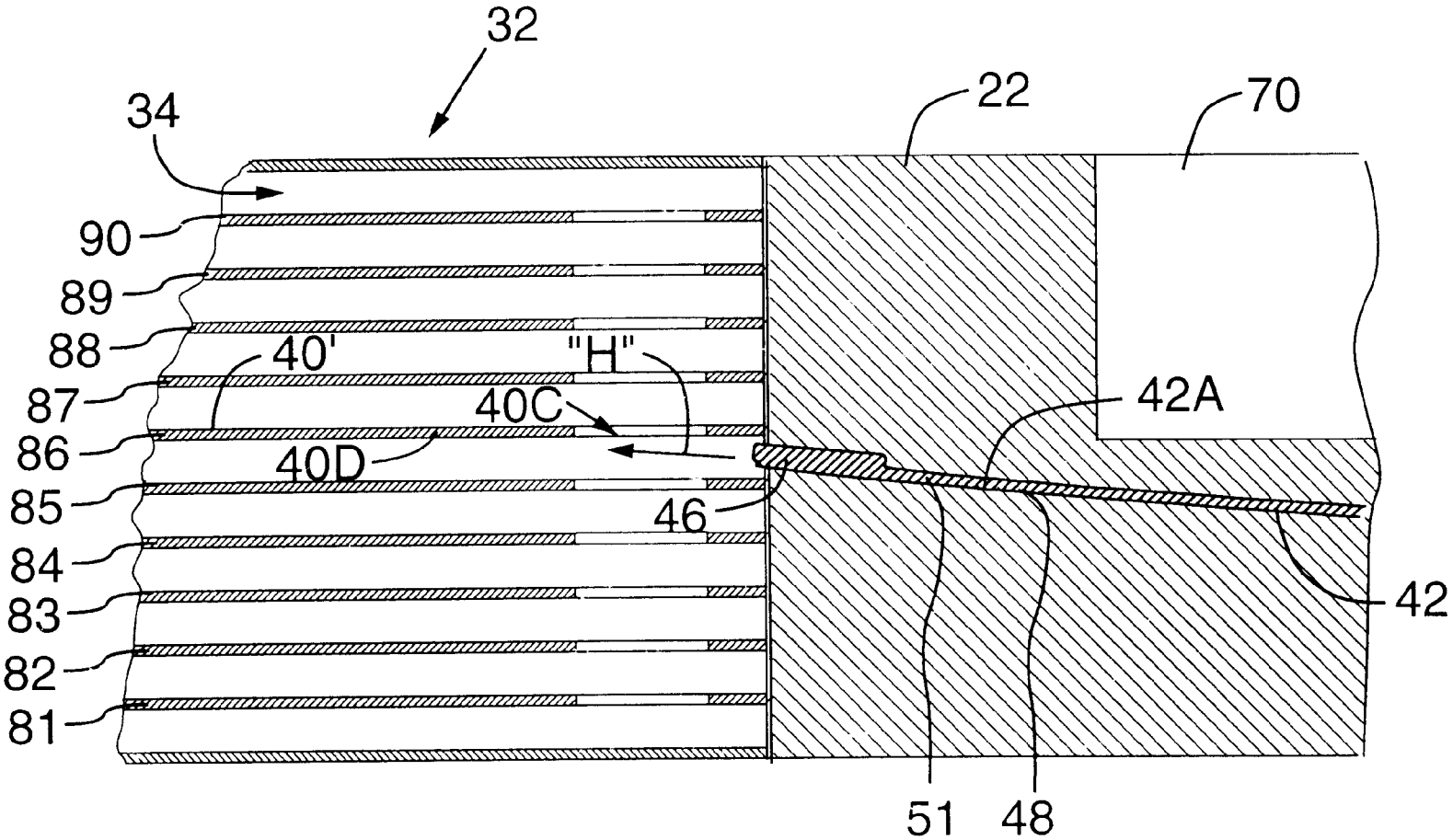
FIG. 27 is a view, similar to FIG. 11, of the tongue portion and the blade cartridge of a cutting/scraping knife according to a second alternate embodiment of the present invention, with the transport mechanism at the rearmost position.
Figure 28:
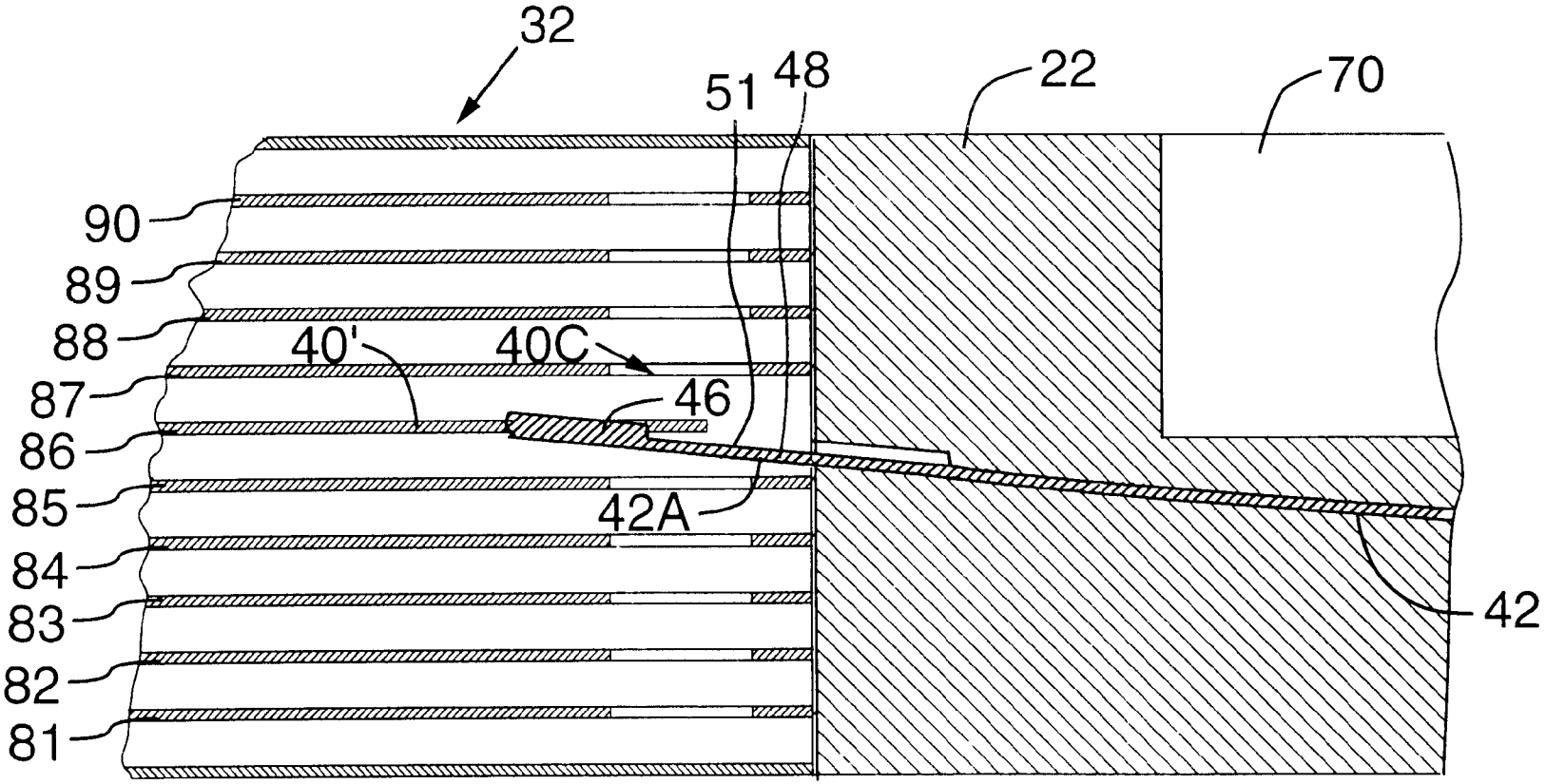
FIG. 28 is a view similar to FIG. 27, showing the detent means in frictional engagement with the first socket means of the selected blade, and the transport mechanism at the forward position.

As well, it will also be appreciated that the teachings of the present invention may be embodied in a cutting/scraping tool with a second alternative embodiment of transport mechanism 42, such that the cutting/scraping tool 20 does not include the deflector means 52 of the preferred embodiment. Such a second alternative embodiment of the transport mechanism is shown in FIG. 27. In this alternative embodiment, the transport mechanism 42 has a flexible, resilient forward tongue portion 42A, the blade engaging detent member 46 being rigidly attached to a forward end 51 thereof. However, in this embodiment, the transport mechanism 42 is adapted such that, upon movement of same from the rearmost position to the intermediate position, the detent means 46 enters the blade cartridge 32 beneath the selected blade 40' and travels in upwardly intersecting angular relation to the longitudinal axis "A", the direction of travel in said upwardly intersecting angular relation being denoted by arrow "H" in FIG. 27, to engage a first socket means 40C in an underside 40D of the selected blade 40', thereby to carry the selected blade 40' by the transport mechanism 42 to the operative position as aforesaid, and as shown in FIG. 28. In all other operative respects, the second alternative embodiment substantially resembles the preferred embodiment.

Finally, it is to be understood that while but three embodiments of the present invention have been herein shown and described, it will be understood that various changes in size and shape of parts may be made without departing from the spirit or scope of the invention, which is only limited by the claims appended hereto.

I claim:

1. A cutting/scraping tool comprising:

a manually grippable housing defining a longitudinal axis and having a head portion adjacent a forward end of the housing, a handle portion adjacent a rearward end of the housing, an axially aligned blade chase formed in the head portion of the housing, and a cartridge receiving chamber formed in the housing and defining a substantially transverse axis;

a blade cartridge, having a blade and a slot, with the blade positioned in the slot;

cartridge positioning means comprised of at least two co-operating portions, a first one of said co-operating portions mounted on an outer surface of the blade cartridge, a second one of said co-operating portions mounted on the housing adjacent a perimeter of the cartridge receiving chamber so as to engage the first one of said co-operating portions to releasably retain said blade cartridge within the cartridge receiving chamber with the blade in aligned registry with the blade chase so as to define a loading position;

a slidable transport mechanism mounted on the housing for sliding movement along an axis substantially parallel to said longitudinal axis between forward and intermediate positions and having a manually engageable actuator projecting from the housing to effect said sliding movement of said transport mechanism, said transport mechanism having a blade engaging detent means positioned on the transport mechanism within the housing adjacent a forward end of said transport mechanism for carrying engagement with said blade;

whereby positioning of the transport mechanism at the forward position causes the blade, carried from the slot by the detent means, to project in an operative position from the blade chase so as to present a first sharpened edge of said blade for use, and sliding movement of the transport mechanism from the forward position to the intermediate position causes the blade to be retracted from said operative position into the loading position.

2. A cutting/scraping tool according to claim 1, wherein the transport mechanism is adapted for slidable longitudinal movement to a rearmost position rearwardly longitudinally disposed from the intermediate position, and sliding movement of the transport mechanism from the intermediate position to the rearmost position causes the blade engaging detent means to disengage from the blade when the blade is at the loading position.

3. A cutting/scraping tool according to claim 2, wherein the transport mechanism is fully removed rearwardly from the blade cartridge when said transport mechanism is at the rearmost position, so as to permit selective transverse removal of the blade cartridge from the cartridge receiving chamber.

4. A cutting/scraping tool according to claim 3, wherein the transport mechanism has a flexible, resilient, forwardly-directed tongue portion, the blade engaging detent means being formed adjacent a forward end of said tongue portion, and the transport mechanism is adapted such that, upon movement of same from the rearmost position to the intermediate position, the detent means enters the blade cartridge beneath the blade and travels in upwardly intersecting angular relation to the longitudinal axis to engage a first socket means in an underside of the blade for said subsequent carriage of the blade by the transport mechanism from the loading position to the operative position.

5. A cutting/scraping tool according to claim 3, wherein the transport mechanism comprises a flexible, resilient forwardly-directed tongue portion with the blade engaging detent means being formed adjacent a forward end thereof, and wherein the blade cartridge further comprises a deflector means fixedly positioned beneath the blade in the blade cartridge, said tongue portion and said deflector means being adapted such that, upon said movement of the transport mechanism from the rearmost position to the intermediate position, the detent means enters into the blade cartridge beneath the blade, and is deflected upwardly by the deflector means to carryingly engage a first socket means positioned on an underside of the blade, for subsequent carriage of the blade by the transport mechanism from the loading position to the operative position.

6. A cutting/scraping tool according to claim 5, wherein the deflector means comprises an inclined ramp portion, and upon said movement of the transport mechanism from the rearmost position to the intermediate position, the detent means enters into the blade cartridge beneath the blade in a direction substantially parallel to the longitudinal axis and is thereafter deflected upwardly by the inclined ramp portion to carryingly engage the first socket means.

7. A cutting/scraping tool according to claim 6, wherein the blade engaging detent means comprises an upwardly projecting tab member, and the first socket means comprises an opening in the blade which is sized and proportioned for operative frictional engagement with said tab member.

8. A cutting/scraping tool according to claim 7, wherein the blade cartridge further comprises a plurality of substantially planar blades positioned within the slot in the blade cartridge in vertically stacked, spaced, substantially parallel relation, with a plurality of deflector means interleaved one each therebetween, and wherein the cartridge positioning means is adapted for movement of the blade cartridge along said transverse axis to move a selected one of the plurality of blades into the loading position for subsequent selective movement by the transport mechanism to the operative position.

9. A cutting/scraping tool according to claim 8, wherein the blades each comprise a second sharpened edge longitudinally rearwardly disposed from the first sharpened edge of each said blade and a second socket means forwardly disposed from the first socket means of each said blade, and wherein the deflector means each comprise a declined ramp portion forwardly disposed from the inclined ramp portion of each said deflector means, said second sharpened edges, the second socket means and the declined ramp portions being arranged, with relation to a plane normal to the longitudinal axis and extending through an axial midpoint of the blade cartridge, in transverse symmetry with the first sharpened edges, the first socket means and the inclined ramp portions, the blade cartridge being releasably retained within the cartridge receiving chamber with the first sharpened edges being forwardly disposed from the second sharpened edges, so as to define a forwardly-directed orientation of the blade cartridge.

10. A cutting/scraping tool according to claim 9, wherein the cartridge positioning means is further adapted to selectively releasably retain the blade cartridge within the cartridge receiving chamber with the second sharpened edges being forwardly disposed from the first sharpened edges, so as to define a second rearwardly-directed orientation of the blade cartridge, for subsequent carriage of the selected blade by the transport mechanism to the operative position, so as to present the second sharpened edge of the selected blade for use.

11. A cutting/scraping tool according to claim 10, wherein the cartridge positioning means comprises a plurality of detent recesses positioned on the housing adjacent a perimeter of the cartridge receiving chamber and a plurality of complementary detent lugs extending laterally from the outer surface of the blade cartridge and adapted to frictionally engage said detent recesses.

12. A cutting/scraping tool according to claim 11, wherein the inclined ramp portion and the declined ramp portion of each said deflector means are each joined by a respective one of a plurality of substantially V-shaped portions, each said V-shaped portion having a lower ridge and laterally spaced side edges, each side edge being rigidly connected to a respective inner side surface of the blade cartridge so as to fixedly position said deflector means in the blade cartridge.

13. A cutting/scraping tool according to claim 12, wherein the deflector means are each constructed of a flexible and resilient material and are each adapted such that, during movement of the transport mechanism between the rearmost position and the forward position, the detent means is deflected upwardly by a respective one of the inclined ramp portions and an apex ridge of said respective one of the inclined ramp portions is compressed downwardly by the transport mechanism when the blade cartridge is in the forwardly-directed orientation, and the detent means is deflected upwardly by a respective one of the declined ramp portions and an apex ridge of said respective one of the declined ramp portions is compressed downwardly by the transport mechanism when the blade cartridge is in the rearwardly-directed orientation.

14. A cutting/scraping tool according to claim 13, wherein the blades and the deflector means are arranged in vertically stacked alternating abutting relation, for support of said blades by said deflector means in said vertically stacked, spaced, substantially parallel relation.

15. A cutting/scraping tool according to claim 14, wherein the inclined ramp portions and the declined ramp portions each have, adjacent a base thereof, an upturned lip portion.

16. A cutting/scraping tool according to claim 15, wherein the blades each additionally comprise two laterally extending and longitudinally spaced grooves on the underside thereof, the grooves of each said blade being respectively adapted to releasably, frictionally receive the apex ridges of the deflector means abutting the underside of said blade, said grooves being adapted for the release of the selected blade for carriage by the detent means.

17. A cutting/scraping tool according to claim 16, wherein the first sharpened edge and the second sharpened edge of the selected blade are oriented horizontally and substantially normal to the longitudinal axis of the housing when the selected blade is at the operative position, and wherein the handle portion is shaped and dimensioned for ergonomic comfort for substantially horizontal movement of the cutting/scraping tool.

18. A cutting/scraping tool according to claim 16, wherein the first sharpened edge and the second sharpened edge of the selected blade are oriented horizontally and substantially parallel to the longitudinal axis of the housing when the selected blade is at the operative position, wherein the plane of the selected blade is oriented substantially vertically, and wherein the handle portion is shaped and dimensioned for ergonomic comfort for substantially vertical movement of the cutting/scraping tool.

* * * * *